US008016479B2

(12) United States Patent
Imai et al.

(10) Patent No.: US 8,016,479 B2
(45) Date of Patent: Sep. 13, 2011

(54) DISPERSING APPARATUS, DISPERSION METHOD, AND METHOD OF MANUFACTURING DISPERSION

(75) Inventors: Kengo Imai, Saitama (JP); Toshinari Sekine, Saitama (JP); Tatsuya Nozaki, Saitama (JP); Kazuhiro Kabasawa, Saitama (JP)

(73) Assignee: Tokyo Printing Ink. Mfg. Co., Ltd., Kita-ku, Tokyo (JP)

( * ) Notice: Subject to any disclaimer, the term of this patent is extended or adjusted under 35 U.S.C. 154(b) by 902 days.

(21) Appl. No.: 11/996,837

(22) PCT Filed: Jul. 24, 2006

(86) PCT No.: PCT/JP2006/314602

§ 371 (c)(1),
(2), (4) Date: Jan. 25, 2008

(87) PCT Pub. No.: WO2007/013415

PCT Pub. Date: Feb. 1, 2007

(65) Prior Publication Data

US 2010/0149903 A1 Jun. 17, 2010

(30) Foreign Application Priority Data

Jul. 25, 2005 (JP) ..... 2005-213636
Jan. 11, 2006 (JP) ..... 2006-003845

(51) Int. Cl.
*B01F 7/20* (2006.01)

(52) U.S. Cl. ..... 366/314; 366/147; 366/327.3; 366/330.3

(58) Field of Classification Search ..... 366/64–67, 366/96–98, 147, 149, 312, 314, 325.4, 325.5, 366/270, 262–263, 265, 279, 309, 329.1–329.3, 366/327.1–327.4, 330.1–330.7
See application file for complete search history.

(56) References Cited

U.S. PATENT DOCUMENTS 3,266,738 A 8/1966 Goeser et al.
4,230,615 A 10/1980 Crocker et al.
4,878,627 A * 11/1989 Otto ..... 241/199.12
5,112,192 A 5/1992 Weetman
5,304,355 A * 4/1994 Yant et al. ..... 422/225

(Continued)

FOREIGN PATENT DOCUMENTS

JP 64-004892 4/1985

(Continued)

OTHER PUBLICATIONS

International Search Report for PCT/JP2006/314602 dated Oct. 3, 2006.

(Continued)

*Primary Examiner* — Charles E Cooley
(74) *Attorney, Agent, or Firm* — Rankin, Hill & Clark LLP

(57) ABSTRACT

There is provided a dispersion method of stirring a material to be dispersed in a cavity of a container, so as to create a laminar flow of the material by the stirring action, and a dispersing apparatus including a bottom member and a column-shaped rotating shaft that rotates in the cavity of the container, in which the rotating shaft is provided with two vanes attached thereto with a predetermined inclination, at positions circumferentially spaced by 180 degrees, and the vanes are located at non-overlapping positions in an axial direction.

29 Claims, 24 Drawing Sheets

U.S. PATENT DOCUMENTS

| | | | | |
|---|---|---|---|---|
| 5,356,215 | A * | 10/1994 | Inoue et al. | 366/293 |
| 5,358,328 | A * | 10/1994 | Inoue et al. | 366/65 |
| 5,393,141 | A * | 2/1995 | Bornemann | 366/149 |
| 6,523,996 | B2 * | 2/2003 | Proper | 366/314 |
| 6,582,866 | B2 * | 6/2003 | Kumar et al. | 430/108.1 |
| 6,586,150 | B2 * | 7/2003 | Proper | 430/137.1 |
| 6,599,673 | B2 * | 7/2003 | Kumar et al. | 430/137.21 |
| 6,752,561 | B2 * | 6/2004 | Kumar et al. | 403/137 |
| 6,756,173 | B2 * | 6/2004 | Proper | 430/111.4 |
| 6,805,481 | B2 * | 10/2004 | Kumar et al. | 366/314 |
| 6,878,499 | B2 * | 4/2005 | Proper | 430/137.2 |
| 6,899,455 | B2 * | 5/2005 | Proper | 366/285 |
| 7,097,349 | B2 * | 8/2006 | Casalmir et al. | 366/309 |
| 7,235,339 | B2 * | 6/2007 | Casalmir et al. | 430/137.21 |
| 2003/0063521 | A1 * | 4/2003 | Kumar et al. | 366/314 |
| 2003/0198127 | A1 * | 10/2003 | Kumar et al. | 366/314 |
| 2006/0092762 | A1 * | 5/2006 | Casalmir et al. | 366/314 |
| 2010/0149903 | A1 * | 6/2010 | Imai et al. | 366/77 |

FOREIGN PATENT DOCUMENTS

| | | |
|---|---|---|
| JP | 63-119716 | 5/1988 |
| JP | 04-227042 | 8/1992 |
| JP | 05-285359 | 11/1993 |
| JP | 06-023255 | 2/1994 |
| JP | 08-224056 | 9/1996 |
| JP | 3043904 U | 9/1997 |
| JP | 10-015376 | 1/1998 |
| JP | 10-151332 | 6/1998 |
| JP | 2000-167826 | 6/2000 |
| JP | 2001-105426 | 4/2001 |
| JP | 2001-105427 | 4/2001 |
| JP | 2003-175325 | 6/2003 |
| JP | 2003-311137 | 11/2003 |
| JP | 2004-202280 | 7/2004 |

OTHER PUBLICATIONS

Japanese Office Action dated Feb. 1, 2011 and partial translation.

* cited by examiner

HPC／FUR STRIPPING 1 MINUTE ( x 10000)

HPC／FUR STRIPPING 1 MINUTE ( x 10000)

HPC／FUR STRIPPING 10 MINUTES ( x 10000)

HPC／FUR STRIPPING 30 MINUTES ( x 10000)

MAPPING OF ELEMENT (HPC／FUROSEMIDE : x10000)

DISTRIBUTION OF PHOSPHOR ATOM

DISPERSING APPARATUS, DISPERSION METHOD, AND METHOD OF MANUFACTURING DISPERSION

TECHNICAL FIELD

The present invention relates to an apparatus and method for dispersing a liquid and/or powder-particles, and to a method of manufacturing a dispersion based on the dispersion method.

BACKGROUND ART

Numerous dispersion methods have so far been proposed for uniformly dispersing a liquid and another liquid, a liquid and a solid, or a solid and another solid to thereby obtain a dispersion in a liquid or powder state, or in a molten state as the case may be, and many apparatuses based on those methods have been developed.

The mixing and dispersing apparatuses that are known include mechanical mixing and kneading apparatuses, such as a roll mill, an extruder, a kneader, and a Henschel mixer. These mechanical mixing and kneading apparatuses rotate a vane that serves as a rotary mixing and stirring bar in a cavity at a high speed, so as to squeeze a material to be dispersed into the gap between the vane and the cavity or to apply an impact force of the vane to the material to be dispersed containing a dispersion medium, an additive and so on for mixing and dispersing, and the material to be dispersed is turbulent-stirred.

Patented documents 1 to 4 disclose a batch mixer including a vane that rotates at a high speed to work as a rotary mixing and stirring bar, to thereby stir a material to be dispersed with the vane thus giving a uniform dispersion.

Further, patented documents 5 and 6 disclose a softening/melting type mixing and kneading apparatus, which mixes and stirs a thermoplastic resin and a coloring agent, which are the material to be dispersed, to thereby soften or melt the thermoplastic resin utilizing frictional heat generated in this process, thus giving a uniform dispersion containing the thermoplastic resin and the coloring agent.

Patented document 7 discloses an apparatus that mixes and disperses an organic pigment and a resin injected into a gap between disk-shaped plates, in a description of a method of dispersing the organic pigment in the resin, and the dispersion methods described in those patented documents are all based on the turbulent-stirring.

[Patented document 1] U.S. Pat. No. 3,266,738
[Patented document 2] U.S. Pat. No. 4,230,615
[Patented document 3] JP-B No. S64-4892
[Patented document 4] JP-A No. H10-151332
[Patented document 5] JP-A No. 2001-105426
[Patented document 6] JP-A No. 2001-105427
[Patented document 7] JP-A No. 2000-167826

DISCLOSURE OF THE INVENTION

Problem to be Solved by the Invention

The foregoing roll mill, extruder, kneader, and the Henschel mixer, as well as the mechanical mixing and kneading apparatuses disclosed in the patented documents 1 to 4 and 7 often fail to give the uniform dispersion unless the material to be dispersed enters the molten state, and a mixing or heating process of a long duration is required to achieve the molten state.

The long-time mixing process may incur a structural change of the material to be dispersed because of the impact force of the mixing and stirring bar, thereby provoking characteristic degradation. The long-time heating process incurs the characteristic degradation.

Besides, in the case where the apparatus has a complicated structure and the type of the material to be dispersed has to be changed, it takes a long time for the disassembly and cleaning and hence the productivity is lowered, especially when handling many types.

Accordingly, as proposed by the patented documents 5 and 6, a simple structure that can be easily disassembled and cleaned may be employed, and the resin and the coloring agent may be mixed and stirred for dispersion at a temperature higher than the softening temperature of the resin, utilizing the frictional heat generated by the stirring action.

However, the dispersion cannot be obtained in a powder state because the dispersion takes place at a high temperature exceeding the softening temperature, and besides the resin and the coloring agent, which are the materials to be dispersed, may incur a change in molecular weight due to the heat or characteristic degradation due to oxidation, and further the produced dispersion may also incur characteristic degradation because of the heat.

As described above, the conventional dispersion methods and dispersing apparatuses, including those disclosed in the patented documents, are all based on the turbulent flow, and therefore involve the problem that the dispersion efficiency is low, and hence fine and uniform dispersion cannot be performed.

The present invention has been achieved with an object to solve the foregoing problem, by providing a dispersion method that allows efficiently obtaining a fine dispersion having excellent uniform dispersibility while suppressing characteristic degradation, a dispersing apparatus that provides such dispersion with a simple structure, and a method of manufacturing the dispersion with such dispersing apparatus.

Means for Solving the Problem

According to the present invention, there is provided a first dispersing apparatus comprising a container having a cylindrically shaped cavity; a stirring member pivotally supported rotatably and coaxially with the cavity, and disposed inside the cavity; and a rotational driving unit that rotationally drives the stirring member in a predetermined direction, to thereby stir a material to be dispersed introduced into the cavity of the container, with the stirring member rotationally driven by the rotational driving unit; wherein the stirring member includes a column-shaped rotating shaft rotatably supported so as to be rotationally driven by the rotational driving unit, and a plurality of vanes provided at an even number of positions on an outer circumferential surface of the rotating shaft at regular intervals along a rotation direction; an odd-numbered vane counted along the rotation direction has an attack angle of a negative value and is located at a relatively lower position and an even-numbered vane has an attack angle of a positive value and is located at a relatively upper position, with the axial direction of the rotating shaft being taken as up-and-down direction; and $-A/2 \leqq B \leqq A/2$ is satisfied, where A represents a vertical width of the vane and B represents a distance between an upper edge of the odd-numbered vane and a lower edge of the even-numbered vane.

According to the present invention, there is provided a second dispersing apparatus comprising a container including a bottom member, a cylindrically shaped wall member, and a lid member; a column-shaped rotating shaft that rotates inside the cavity of the container, and is attached to the bottom member or the lid member such that an axial center of the rotating shaft becomes parallel to the cylindrically shaped wall member; and a pair of vanes attached to the rotating shaft with a predetermined inclination with respect to a rotation direction, and circumferentially spaced by 180 degrees and axially shifted from each other; wherein the vane on the bottom member side is inclined such that a rear portion with respect to a rotation direction is elevated from the rotation plane toward the lid member; the vane on the lid member side is inclined by the same angle as the vane on the bottom member side, such that a rear portion with respect to the rotation direction is lowered from the rotation plane away from the lid member; a vane closest to the bottom member and a vane closest to the lid member out of the pair of vanes thus attached are located close to the bottom member and to the lid member respectively but not in contact therewith; and a laminar flow is created when a material to be dispersed is stirred in the cavity of the container.

According to the present invention, there is provided a third dispersing apparatus comprising a container having a cylindrically shaped cavity; a stirring member pivotally supported rotatably and coaxially with the cavity, and disposed inside the cavity; and a rotational driving unit that rotationally drives the stirring member, to thereby stir a material to be dispersed introduced into the cavity of the container, with the stirring member rotationally driven by the rotational driving unit; wherein the stirring member rotates in a predetermined direction to thereby cause the material to be dispersed to rotate generally parallel to an inner circumferential surface of the cavity, and to reciprocate axially of the rotating shaft.

According to the present invention, there is provided a dispersion method comprising creating a laminar flow of a material to be dispersed, upon stirring the material to be dispersed in a cavity of a container.

Also, the dispersion method may comprise employing the dispersing apparatus according to the present invention, for stirring the material to be dispersed.

Further, the dispersion method may comprise employing a stirring member so as to cause the material to be dispersed introduced into the container to rotate generally parallel to an inner circumferential surface of the cavity, and to reciprocate axially of the rotating shaft.

According to the present invention, there is provided a method of manufacturing a dispersion, comprising employing the dispersing apparatus according to the present invention for dispersing a material to be dispersed including a dispersion medium and an additive to be dispersed therein.

Here, the constituents of the present invention do not always have to be individually independent, but may be arranged such that a plurality of constituents constitutes a unified member; a plurality of members constitutes a constituent; a constituent is a part of another constituent; a part of a constituent also serves as a part of another constituent; or the like.

Also, although the present invention refers to the up-and-down direction as the case may be, this is merely for convenience sake for explicitly explaining a relative relationship between the constituents of the present invention. Accordingly, such expression is not intended to determine a direction in a manufacturing process or use in executing the present invention.

Further, a positive attack angle of the vane referred to in the present invention means that the vane is inclined so as to deflect downward an opposing flow of a fluid. A negative attack angle of the vane means that the vane is inclined so as to deflect upward an opposing flow of a fluid.

Further, the plane referred to in the present invention means a surface physically formed aiming at a plane, and naturally does not have to be a geometrically perfect plane. The stall angle referred to in the present invention means a maximal attack angle at which a flow of a fluid maintains a laminar flow without separating from either surface of the vane.

The temperature control flow path according to the present invention means a flow path provided for a heat-transfer fluid employed for temperature control. The heat transfer fluid means a fluid denominated as heating medium or refrigerant, employed for temperature control.

Advantageous Effect of the Invention

The present invention provides a dispersion method that enables efficiently giving a fine and highly uniform dispersion of a liquid and another liquid, a liquid and a solid, or a solid and another solid while suppressing characteristic degradation, a dispersing apparatus that provides such dispersion with a simple structure, and a method of manufacturing a dispersion that employs such dispersing apparatus. Also, the dispersing apparatus may be employed to crush a solid for obtaining fine and uniform crushed object or, if necessary, to process an uneven and angular powder into uniform spherical particles.

BRIEF DESCRIPTION OF THE DRAWINGS

The above and other objects, features and advantages will become more apparent through preferred embodiments given below and the following drawings accompanying the embodiments.

BEST MODE FOR CARRYING OUT THE INVENTION

Figure 1A:
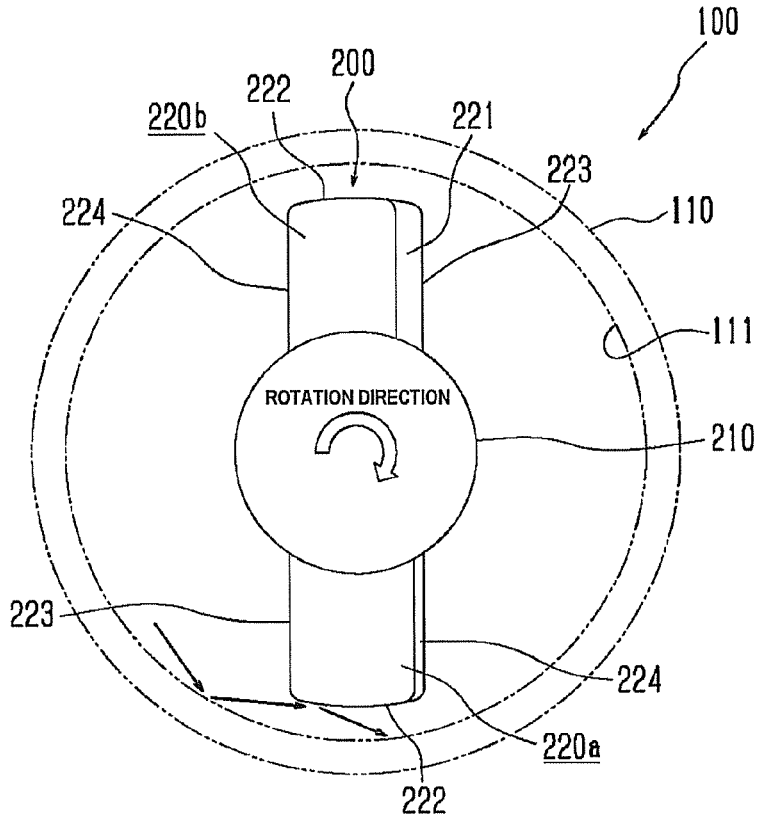
FIG. 1A is a plan view showing an internal structure of a dispersing apparatus according to an embodiment of the present invention, and 1B is a schematic diagram showing a relationship between a vane of a stirring member and flow of a material to be dispersed.

A dispersion method and a dispersing apparatus according to an embodiment of the present invention will be described hereunder, referring to the drawings. It is to be noted that the present invention is not limited to the embodiment, but various modified embodiments may be made without departing from the scope of the present invention.

As a result of consistent studies, the present inventors have achieved a dispersion method that enables, when stirring a material to be dispersed in a cavity of a container, creating a laminar flow of the mixture and thereby uniformly dispersing a liquid and another liquid, a solid and another solid, or a liquid and a solid, as well as a dispersing apparatus that executes such dispersion method, and a method of manufacturing a dispersion that employs such dispersing apparatus.

The dispersing apparatus 100 according to this embodiment includes, as shown in FIGS. 1A to 4B, a container 110 having a cylindrically shaped cavity 111, a stirring member 200 pivotally supported rotatably and coaxially with the cavity 111 and disposed inside the cavity 111; and a rotational driving unit (not shown) that rotationally drives the stirring member 200.

The dispersing apparatus 100 according to this embodiment mixes a material to be dispersed introduced into the cavity 111 of the container 110, with the stirring member 200 rotationally driven by the rotational driving unit. The stirring member 200 is of such a shape that causes the material to be dispersed, by rotating in a predetermined direction, to rotate generally parallel to the inner circumferential surface of the cavity 111, and to axially reciprocate along the rotating shaft 210.

To be more detailed, the stirring member 200 includes a column-shaped rotating shaft 210 rotatably supported to be rotational driven by the rotational driving unit, and a plurality of vanes 220 provided at an even number of positions on the outer circumferential surface of the rotating shaft 210 at regular intervals along a rotation direction.

Also, an odd-numbered vane 220*a* counted along the rotation direction has an attack angle θ of a negative value and is located at a relatively lower position, and an even-numbered vane 220*b* has an attack angle θ of a positive value and is located at a relatively upper position, when the axial direction of the rotating shaft 210 is taken as the up-and-down direction.

Further, when the vertical width of the vane 220 is denoted by A and the distance between the upper edge of the odd-numbered vane 220*a* and the lower edge of the even-numbered vane 220*b* by B, the following condition is satisfied:

$$0 \leq B \leq A/2$$

Here, the vane 220 is of a flat plate shape, such that the plate thickness is sufficiently smaller than the chord length C. Accordingly, the vertical width A of the vane 220 satisfies the following condition, with respect to the chord length C and the attack angle θ:

$$A \text{ nearly equals } C \sin \theta$$

In the dispersing apparatus 100 according to this embodiment, the attack angle θ of the vane 220 is smaller than the stall angle. A plane 221 orthogonal to the axial direction is formed along an extension of the front edge of the vane 220.

The distal edge 222 of the vane 220 is of an arcuate shape parallel to the inner circumferential surface of the cavity 111. The front edge 223 and the rear edge 224 of the vane 220 are parallel. Also, the front-to-back width of the vane 220 parallel to the rotation direction is smaller than the diameter of the rotating shaft 210.

Also, in the dispersing apparatus 100 according to this embodiment, a pair of vanes 200 is separately located at an interval of 180 degrees around the axial center of the rotating shaft 210. Accordingly, the pair of vanes 220 will hereinafter be referred to as a first vane 220*a* and a second vane 220*b*.

Further, in the dispersing apparatus 100 according to this embodiment, the front edge of the first vane 220*a* is located close to the bottom surface of the cavity 111, and the front edge of the second vane 220*b* is located close to the ceiling surface of the cavity 111.

In the present invention, a laminar flow is contrasted with a turbulent flow. The majority of the conventional dispersion methods may be construed to be a dispersion method that utilizes the turbulent flow. However, while the turbulent flow creates a multidirectional flow of the material to be dispersed to thereby apply various types of forces to the material to be dispersed, the laminar flow maintains the flow of the material to be dispersed in a predetermined direction, to thus apply a regular and uniform force to the material to be dispersed.

In the case where a cylindrically shaped inner space is provided as the cavity, the flow of the material to be dispersed moves generally concentrically, and barely moves radially. This can be visually confirmed.

Figure 1B:
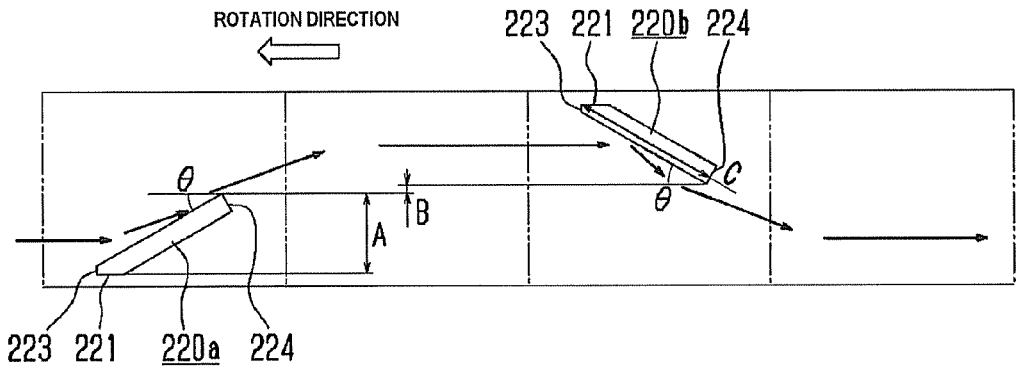
Figure 2A:
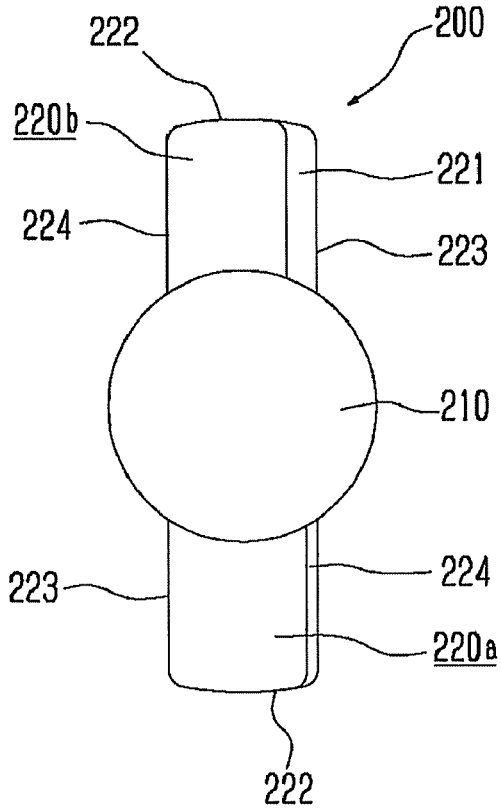
FIGS. 2A to 2C are three-view drawings of the stirring member.
Figure 2B:
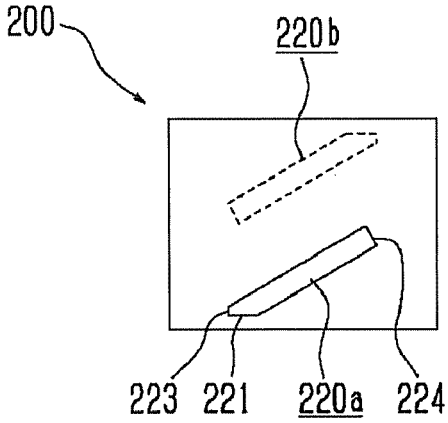
Figure 2C:
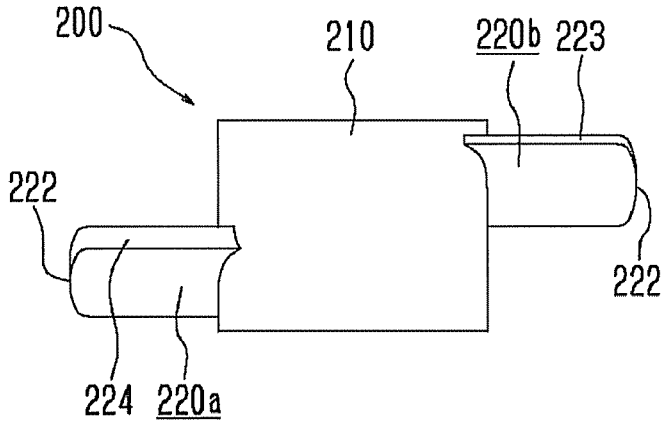
Figure 3:
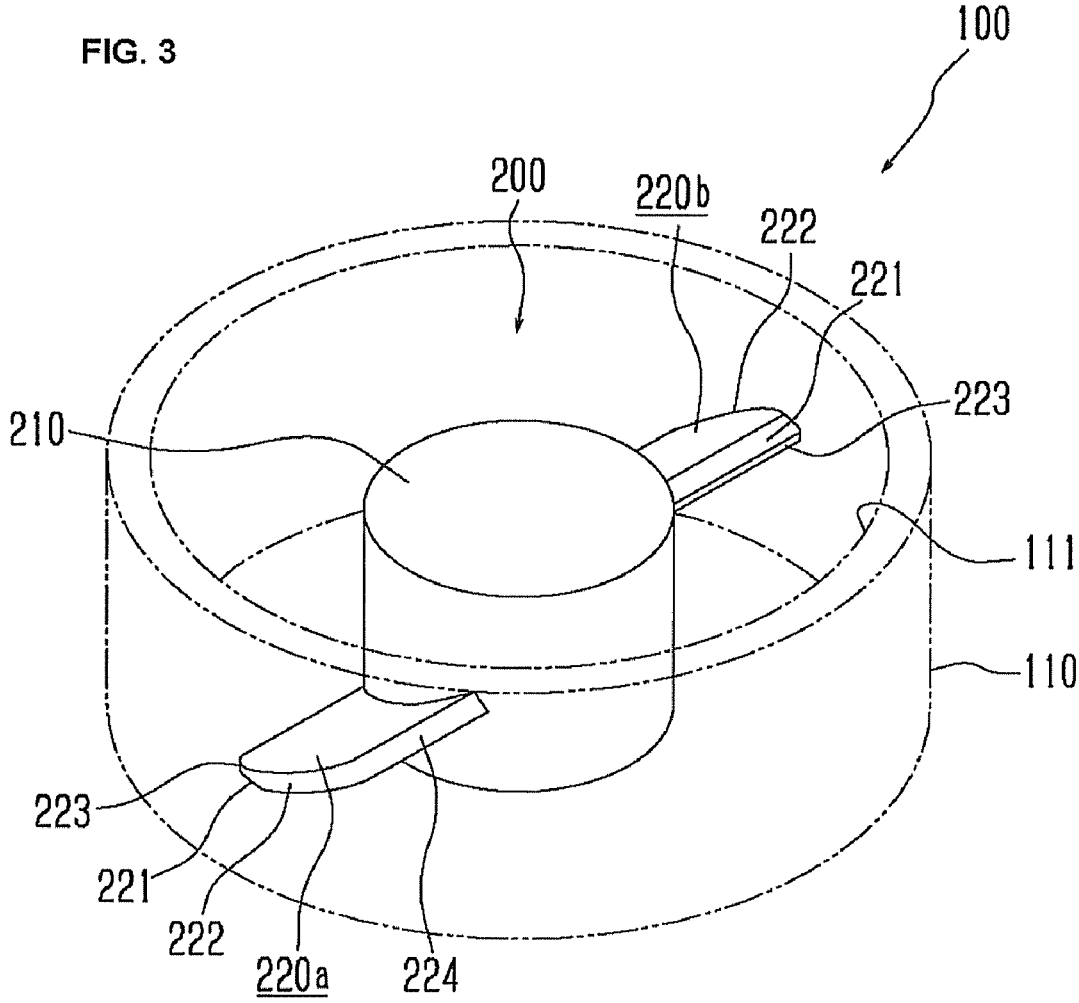
FIG. 3 is a perspective view of the stirring member.

FIGS. 1A and 1B schematically indicate with arrows the flow made of the laminar flow of the material to be dispersed, created upon stirring the material to be dispersed with the dispersing apparatus 100 according to this embodiment. Such flow is based on experiment results visually confirmed by the present inventors upon actually making up the dispersing apparatus 100 and stirring the material to be dispersed.

FIG. 1A is a schematic plan view showing an internal structure of the dispersing apparatus 100. The present inventors observed from above the material to be dispersed being stirred in the dispersing apparatus 100. Then it has been confirmed that, as shown in FIG. 1A, the material to be dispersed radially reciprocates, while rotating, in the vicinity of the gap between the distal edge 222 of the vane 220*a*, 220*b* and the inner circumferential surface of the cavity 111.

Presumably, the material to be dispersed pressed against the inner circumferential surface of the cavity 111, by a centrifugal force generated by the rotation of the vanes 220*a*, 220*b*, reacts and attempts to return to an inner region of the cavity 111, but is again pressed against the inner circumferential surface of the cavity 111 by the vanes 220, and such motion is repeated.

FIG. 1B schematically expresses the first and the second vane 220*a*, 220*b* developed along the rotation direction of the stirring member 200. The present inventors also observed from a lateral direction the material to be dispersed being stirred in the dispersing apparatus 100.

As a result, it has been confirmed that, as shown in FIG. 1B, the material to be dispersed vertically reciprocates between the upper surface of the first vane 220*a* and the lower surface of the second vane 220*b* in the cavity 111, while rotating in the same direction as the vanes 220*a*, 220*b*, and that the flow of the material to be dispersed constitutes the laminar flow.

A presumable reason is as follows. Although the material to be dispersed rotates inside the cavity 111 along with the rotation of the vanes 220*a*, 220*b*, the rotation speed will not reach that of the vanes 220*a*, 220*b*.

Accordingly, the material to be dispersed may be regarded as relatively rotating in the opposite direction against the vanes 220*a*, 220*b*. In this case, the material to be dispersed is conducted upward by the first vane 220*a*, which has a negative attack angle, and downward by the second vane 220*b* having a positive attack angle.

However, the front edge of the first vane 220*a* is located close to the bottom surface of the cavity 111, while the front edge of the second vane 220*b* is located close to the ceiling surface of the cavity 111. Therefore, an entirety of the material to be dispersed which is relatively moving is conducted upward and downward, by the upper surface of the first vane 220*a* and the lower surface of the second vane 220*b*.

Further, since the distance B between the upper edge of the first vane 220*a* and the lower edge of the second vane 220*b* satisfies "$0 \leqq B$" as already stated, the material to be dispersed is not inhibited from flowing. Consequently, the flowing motion of the material to be dispersed being stirred in the dispersing apparatus 100 constitutes the laminar flow.

Such laminar flow constantly applies a regular and uniform force to the material to be dispersed. Accordingly, efficient and uniform dispersing performance can be executed. Here, it is preferable to set the circumferential speed of the distal edge 222 of the vane 220 at 10 m/sec or faster, and more preferably at 20 m/sec or faster, because when the circumferential speed is slower than 10 m/sec the laminar flow cannot be created.

Also, to efficiently disperse the material to be dispersed uniformly and finely, it is necessary to increase collision frequency between the material to be dispersed and the vane 220, between the material to be dispersed and the inner circumferential surface of the cavity 111, and between the material to be dispersed itself.

Such frequency depends on a ratio of a volume of the material to be dispersed included in a donut-shaped mass formed when the material to be dispersed is pressed against the inner circumferential surface of the cavity 111 by the centrifugal force generated by the vane 220.

The thickness of the laminar flow in a radial direction of the cavity 111 is determined based on the density of the material to be dispersed, the circumferential speed of the distal edge 222 of the vane 220, the attachment angle, i.e. the attack angle of the vane 220, the gap between the distal edge 222 of the vane 220 and the inner circumferential surface of the cavity 111 and so on, and can also be visually confirmed.

The volume of the laminar flow can be calculated based on the radial thickness of the laminar flow and the height of the cavity 111. The greater content of the material to be dispersed in the laminar flow increases the collision frequency of the material to be dispersed itself, thereby improving the dispersion efficiency, however the material to be dispersed is prone to incur melting or thermal degradation, because of the frictional heat generated by the collision.

Also, according to the desired state of the dispersion, such as a molten state or powder state, the circumferential speed of the distal edge 222 of the vane 220, the attachment angle, i.e. the attack angle of the vane 220, the gap between the distal edge 222 of the vane 220 and the inner circumferential surface of the cavity 111, the ratio in volume of the material to be dispersed included in the laminar flow and so on may be adjusted, and cooling or heating may be executed if necessary.

It is to be noted that the temperature provided by the foregoing frictional heat of the material to be dispersed being stirred also depends on the quantity of the material to be dispersed loaded in the dispersing apparatus 100, in addition to the characteristics thereof such as the circumferential speed of the vane 220.

Increasing the loaded quantity of the material to be dispersed leads to increased collision frequency, thence to a higher temperature. In other words, in order to stir the material to be dispersed at a desired temperature, the quantity of the material to be dispersed to be loaded in the dispersing apparatus 100 also has to be adjusted.

In the dispersing apparatus 100 according to this embodiment, in the case where, for example, the material to be dispersed has such a property as melting after being softened by the temperature increase, the material to be dispersed can be dispersed under the softened state, without melting by the frictional heat generated by the stirring motion.

Such dispersion may be executed under a state where, for example, a superficial portion of the material to be dispersed is molten because of the frictional heat generated by the stirring motion but a central portion is not molten. Accordingly, it is possible to stir a plurality of solid particles as the material to be dispersed, so as to mix and knead a component of a certain solid particle in another solid particle. In this case, the first solid particle may be a resin particle, and the second solid particle may be a pigment.

Figure 4A:
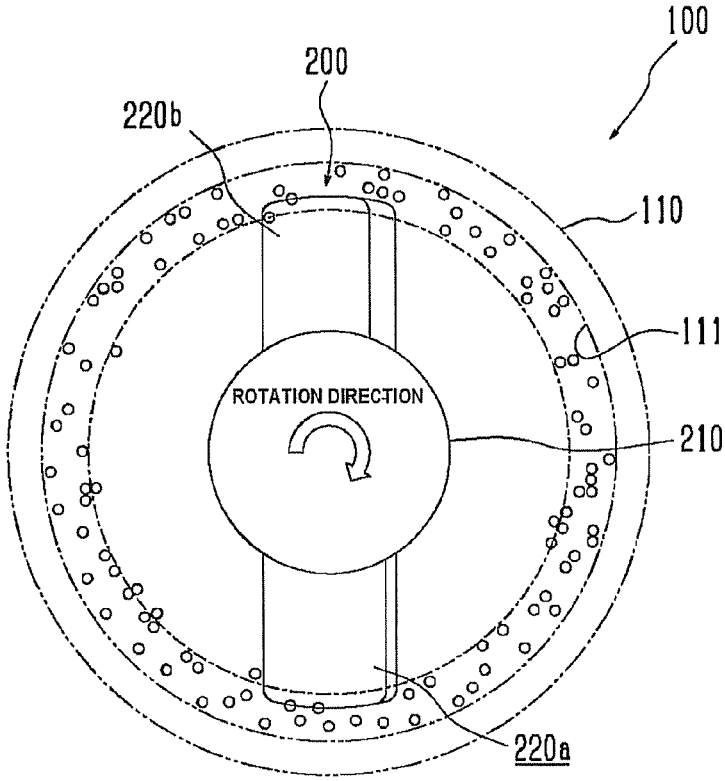
FIGS. 4A and 4B are schematic diagrams showing a state where the dispersing apparatus is stirring the material to be dispersed.
Figure 4B:
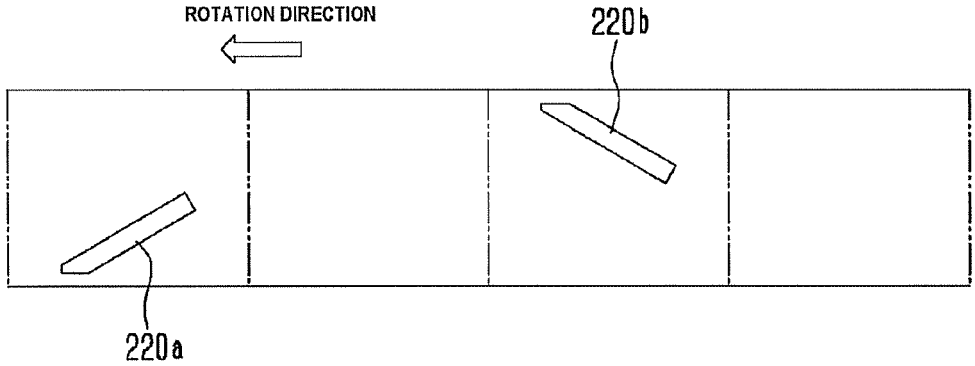
Figure 5A:
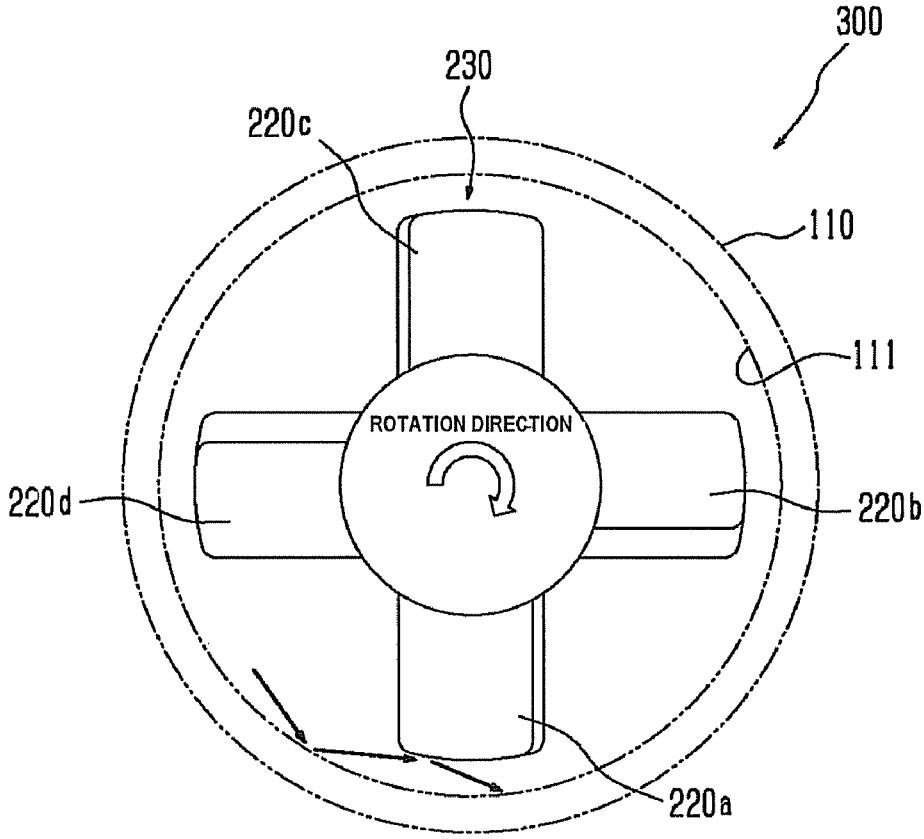
FIG. 5A is a plan view showing an internal structure of a dispersing apparatus according to a modified example, and 5B is a schematic diagram showing a relationship between a vane of a stirring member and flow of a material to be dispersed.
Figure 5B:
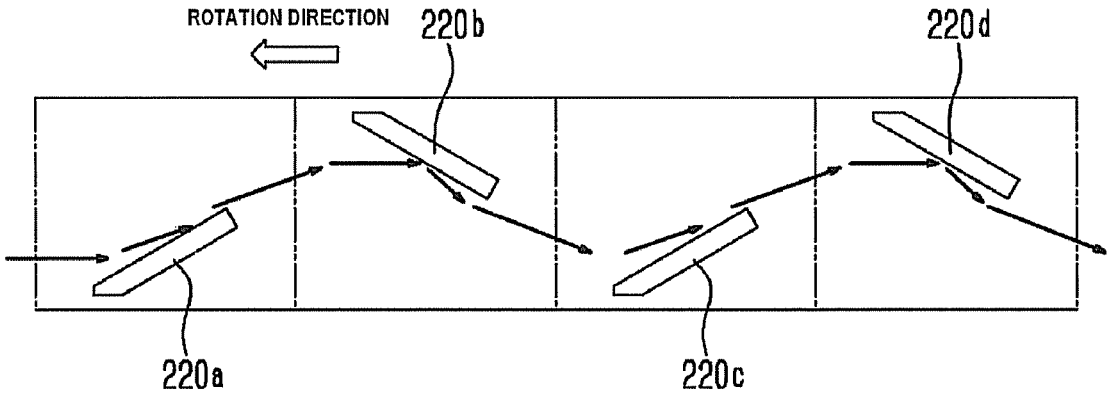
Figure 6A:
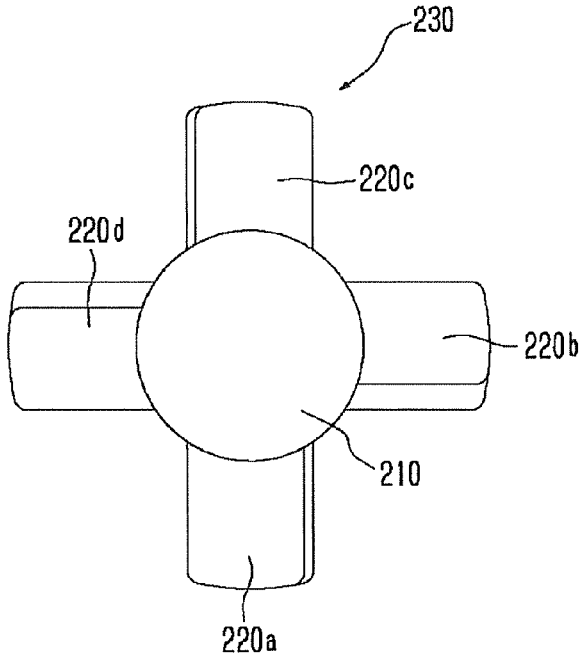
FIGS. 6A to 6C are three-view drawings of the stirring member.
Figure 6B:
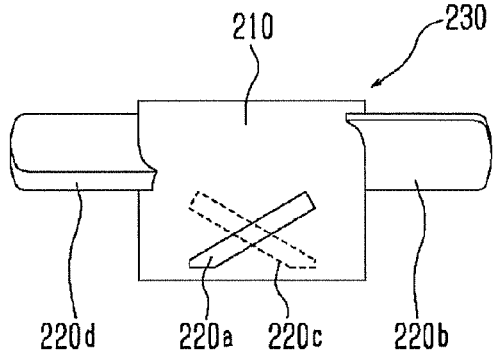
Figure 6C:
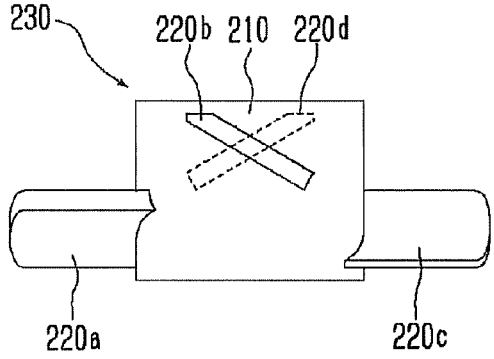
Figure 7:
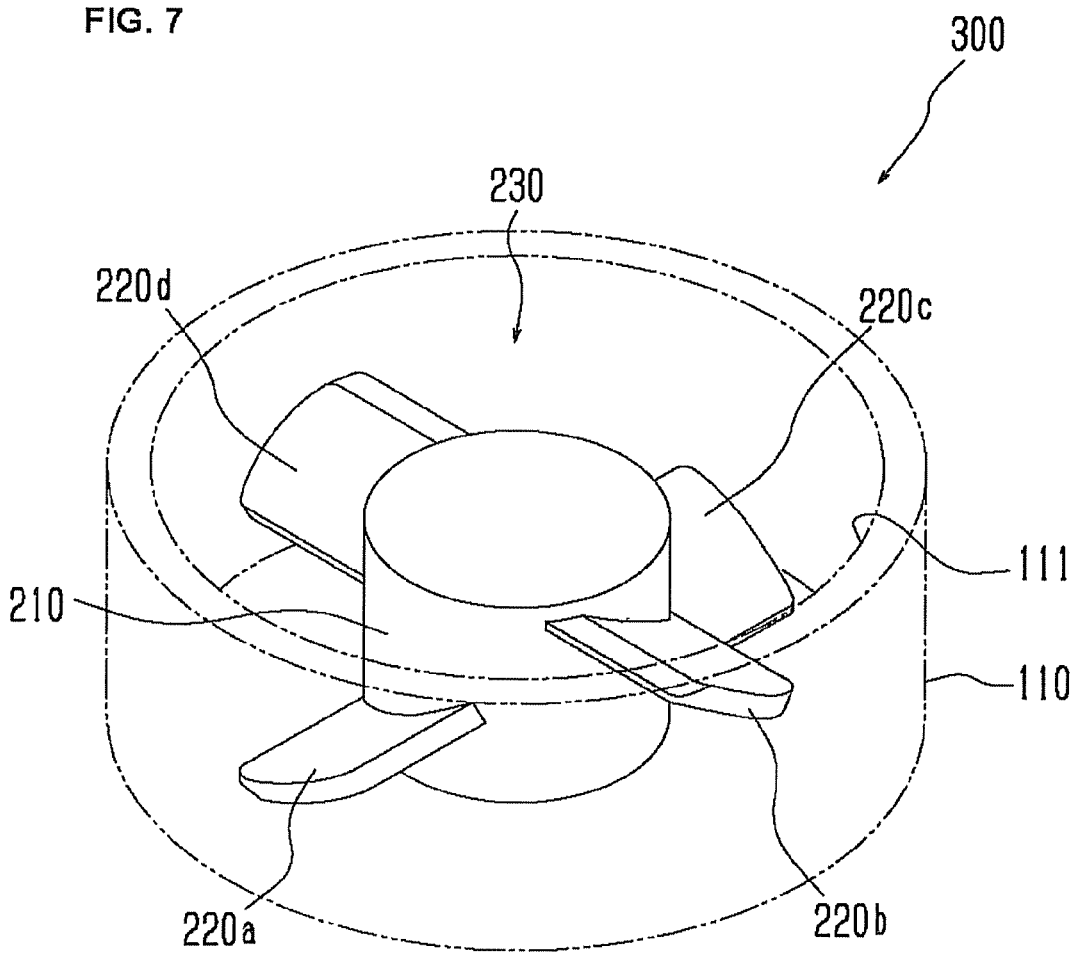
FIG. 7 is a perspective view of the stirring member.
Figure 8A:
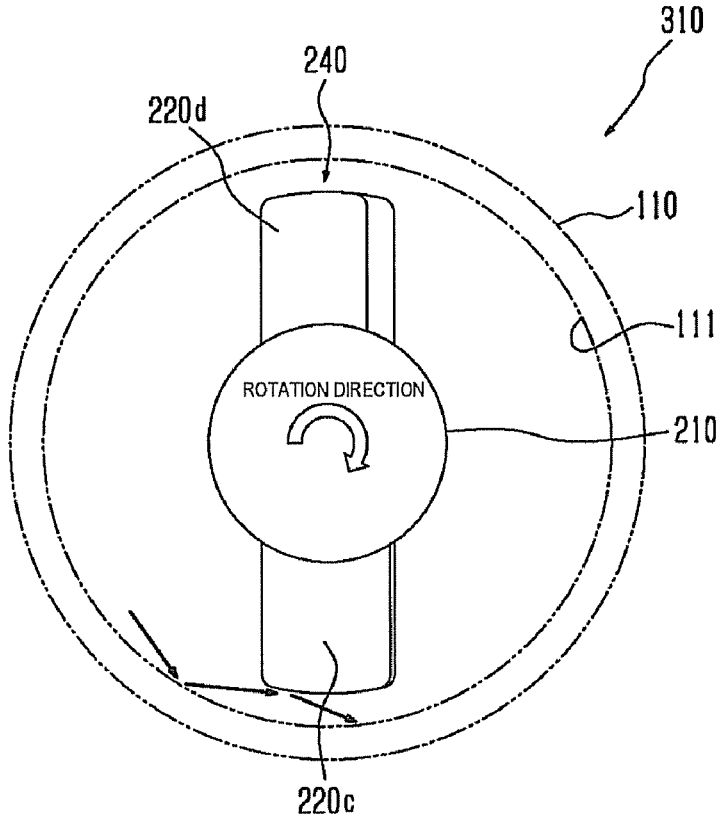
FIG. 8A is a plan view showing an internal structure of a dispersing apparatus according to another modified example, and 8B is a schematic diagram showing a relationship between a vane of a stirring member and flow of a material to be dispersed.
Figure 8B:
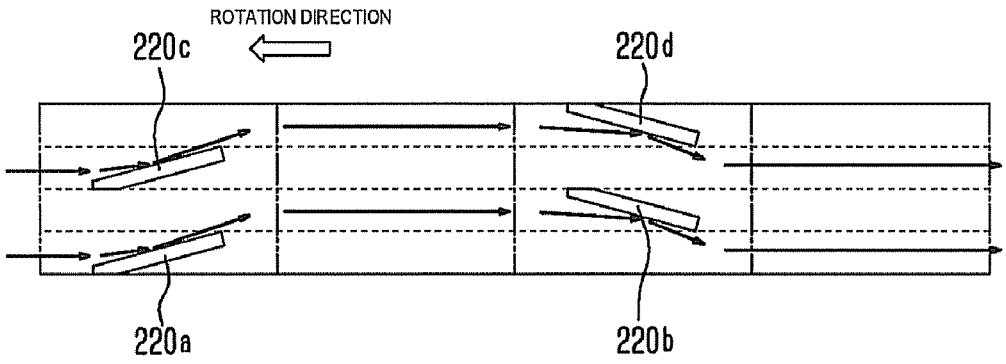
Figure 9A:
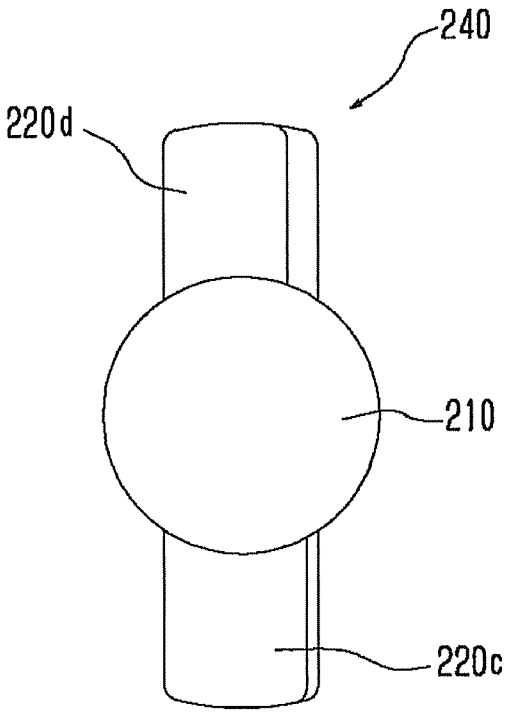
FIGS. 9A to 9C are three-view drawings of the stirring member.
Figure 9B:
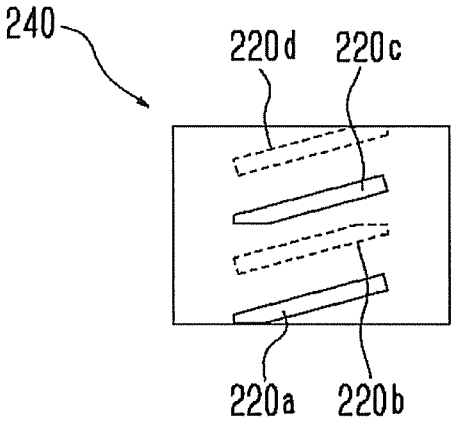
Figure 9C:
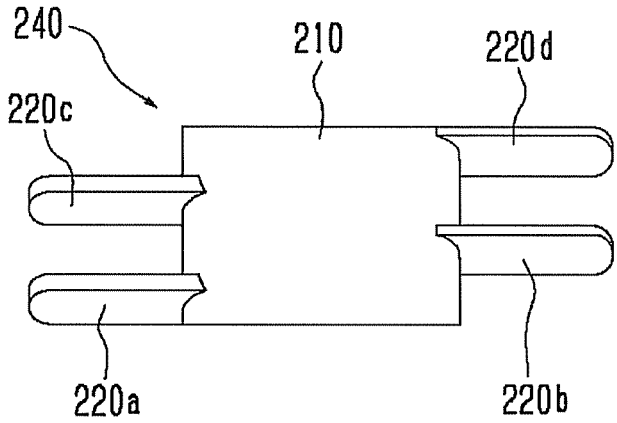
Figure 10:
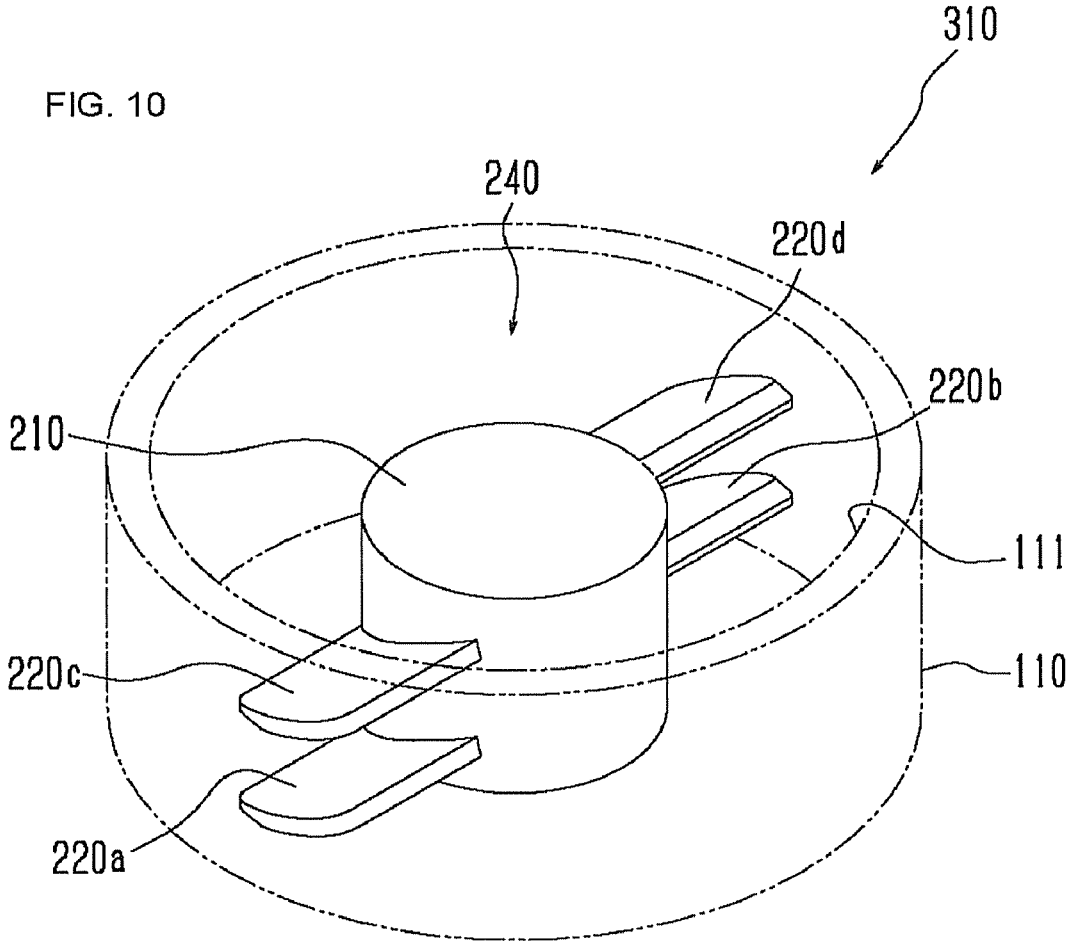
FIG. 10 is a perspective view of the stirring member.

Hereunder, the dispersing apparatus 100 according to this embodiment will be described referring to the drawings. FIGS. 4A and 4B additionally show a donut-shaped laminar flow based on FIGS. 1A and 1B. FIG. 4A depicts a state where the material to be dispersed, represented by small circles, is squeezed into a donut-shaped laminar flow.

The dispersing apparatus 100 according to this embodiment rotates, as already stated, the stirring member 200 in a predetermined direction, to thereby cause the material to be dispersed to rotate generally parallel to the inner circumferential surface of the cavity 111, and to axially reciprocate along the rotating shaft 210.

Accordingly, since the flow motion of the material to be dispersed constitutes the laminar flow, the material to be dispersed remains free from an excessive frictional heat. Therefore, the characteristic degradation of the material to be dispersed can be prevented, while efficiently dispersing the material to be dispersed.

Also, in the dispersing apparatus 100 according to this embodiment, an odd-numbered vane 220*a* counted along the rotation direction has an attack angle θ of a negative value and is located at a lower position, and an even-numbered vane 220*b* has an attack angle θ of a positive value and is located at an upper position, when the axial direction of the rotating shaft 210 is taken as the up-and-down direction.

Further, the vertical width A of the vane 220 and a distance B between the upper edge of the odd-numbered vane 220*a* and the lower edge of the even-numbered vane 220*b* satisfies the following condition:

$$0 \leqq B \leqq A/2$$

Accordingly, with the stirring member 200 of such simple structure, the material to be dispersed can be caused to rotate generally parallel to the inner circumferential surface of the cavity 111 and to axially reciprocate along the rotating shaft 210.

Moreover, in the dispersing apparatus 100 according to this embodiment, the attack angle θ of the vane 220 is smaller than the stall angle. Accordingly, the flow motion of the material to be dispersed can constitute the laminar flow without fail.

Further, the front edge of the first vane 220*a* is located close to the bottom surface of the cavity 111, and the front edge of the second vane 220*b* is located close to the ceiling surface of the cavity 111.

Accordingly, the material to be dispersed can be effectively prevented from intruding into the gap between the lower edge of the first vane 220*a* located at the lower position and the bottom surface of the cavity 111, as well as between the upper edge of the second vane 220*b* located at the upper position and the ceiling surface of the cavity 111. Therefore, the entirety of the material to be dispersed can be effectively stirred.

In particular, a plane 221 orthogonal to the axial direction is formed along the extension of the front edge of the vane 220. Accordingly, the front edge of the first vane 220*a* located at the lower position can be brought close to the bottom surface of the cavity 111, and the front edge of the second vane 220*b* located at the upper position close to the ceiling surface of the cavity 111.

Accordingly, the material to be dispersed can be effectively prevented from intruding into the gap between the first vane 220*a* and the bottom surface of the cavity 111, as well as between the second vane 220*b* and the ceiling surface of the cavity 111.

Thus, it is preferable that the foregoing gap is minimal, as long as the stirring member 200 is kept from scraping the container 100. The gap, which depends on the precision in rotating motion of the stirring member 200, the size of the apparatus and so on, is equal to or more than 1 mm and equal to or less than 10 mm, for example.

Further, the distal edge 222 of the vane 220 is of an arcuate shape parallel to the inner circumferential surface of the cavity 111. Accordingly, an irregularly shaped gap is not formed between the distal edge 222 of the vane 220 and the inner circumferential surface of the cavity 111.

Such structure allows effectively creating the laminar flow from the flow motion between the distal edge 222 of the vane 220 and the inner circumferential surface of the cavity 111. Consequently, the material to be dispersed can be localized in the vicinity of the inner circumferential surface of the cavity 111, and caused to flow under such state. The range of the vicinity of the inner circumferential surface of the cavity 111 where the material to be dispersed is thus localized has a ring shape in a plan view, and three-dimensionally a hollow cylindrical shape.

Besides, the front edge 223 and the rear edge 224 of the vane 220 are parallel. This simplifies the structure of the vane 220. In particular, the relationship between the vertical width A of the vane 220, and the vertical distance B between the upper edge of the odd-numbered vane 220*a* and the lower edge of the even-numbered vane 220*b*, can be appropriately adjusted based on a simple structure.

Also, the front-to-back width of the vane 220 which is parallel to the rotation direction is smaller than the diameter of the rotating shaft 210. Accordingly, the vicinity of the center of rotation of the stirring member 200 is free from a shape that generates a turbulent flow. Therefore, the material to be dispersed can be effectively stirred in a form of the laminar flow.

Here, if the attack angle of the vane 220 is excessively large, the laminar flow cannot be maintained, though it depends on other factors such as the circumferential speed of the distal edge 222, the wing shape and the plan-view wing shape of the vane 220, and viscosity of the fluid. Accordingly, it is preferable that the attack angle of the vane 220 is smaller than the stall angle, so as to maintain the laminar flow. To be more detailed, an absolute value of the attack angle θ of the vane 220 is equal to or larger than 0 degree and equal to or smaller than 90 degrees, and preferably equal to or larger than 5 degrees and equal to or smaller than 45 degrees, and may be 30 degrees for example.

Further, the dispersing apparatus 100 according to this embodiment has the stirring member 200 of a simple structure as stated above, and can be easily cleaned when switching the type of the material to be dispersed. Accordingly, an extensive variety of materials to be dispersed can be easily produced in small lots.

Meanwhile, the foregoing embodiment represents an example where the vertical distance B between the upper edge of an odd-numbered vane 220*a* and the lower edge of an even-numbered vane 220*b* satisfies the relationship of $0 \leqq B$.

However, the distance between the upper edge of the vane 220*a* and the lower edge of the vane 220*b* in an axial direction may be determined in consideration of various factors such as the shape of the vane 220, the diameter of the rotating shaft 210, the rotation speed of the stirring member 200 and the viscosity of the fluid, as long as the laminar flow can be maintained.

Accordingly, it is not impossible that the relationship between the vertical width A of the vane and the vertical distance B between the upper edge of an odd-numbered vane 220*a* and the lower edge of an even-numbered vane 220*b* satisfies "$-A/2 \leqq B \leqq 0$" (not shown).

Also, the foregoing embodiment represents an example where the plurality of vanes 220 is located on an even-number of positions on the outer circumferential surface of the rotating shaft 210 at regular intervals along the rotation direction, such that an odd-numbered vane 220*a* counted along the rotation direction has an attack angle θ of a negative value and is located at a lower position, and an even-numbered vane 220*b* has an attack angle θ of a positive value and is located at an upper position, when the axial direction of the rotating shaft 210 is taken as the up-and-down direction.

However, this means that the stirring member 200 is provided with the vanes 220 that satisfy the foregoing condition, and is free from a structure that disturbs the fluid-dynamic function of the vanes 220.

Accordingly, the stirring member having the vanes that satisfy the foregoing condition may further include a vane-shaped projection of such a shape and location that does not disturb the laminar flow of the material to be dispersed (not shown).

Also, a third vane (not shown) not involved with the laminar flow may be provided, as long as the second vane 220 located adjacent to the first vane 220 in the rotation direction is provided, and the first vane 220 has an attack angle θ of a negative value and is located at a relatively lower position and the second vane 220 has an attack angle θ of a positive value and is located at a relatively upper position.

Figure 15:
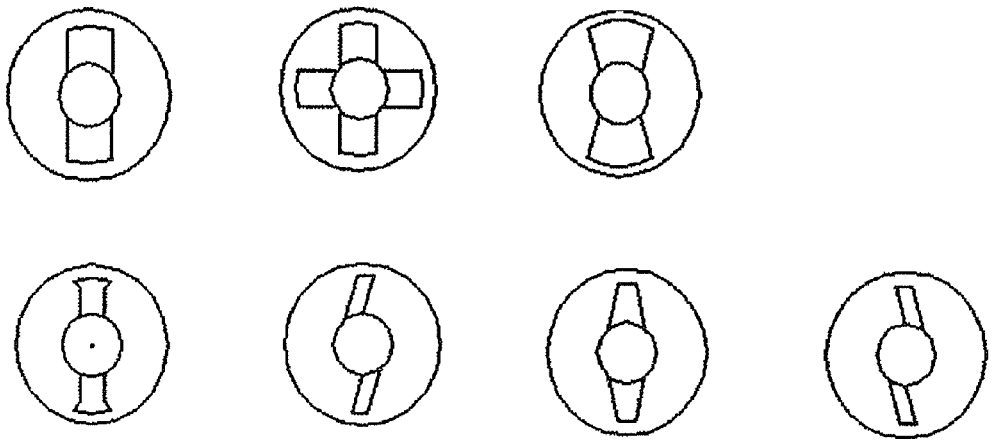
FIG. 15 includes plan views showing various modified examples of the stirring member.

Also, the shape of the vane 220 may be of various different shapes, provided that the laminar flow is not disturbed. Regarding the plan-view shape of the vane, for example, FIG. 15 shows various examples, however different shapes may be adopted as long as the laminar flow can be maintained. Referring to the vane shape, it is important that the vane 220 does not have an angular portion, in order not to disturb the laminar flow.

Further, the foregoing embodiment represents an example where the distal edge 222 of the vane 220 is of an arcuate shape parallel to the inner circumferential surface of the cavity 111. However, the gap between the distal edge 222 of the vane 220 and the inner circumferential surface of the cavity 111 is not limited to such structure.

For example, adjusting the gap, the vane angle, and the circumferential speed of the distal edge 222 allows controlling the force applied by the distal edge 222 of the vane 220 to the material to be dispersed. However, in order to prevent the characteristic degradation of the material to be dispersed due to the impact force and frictional heat between the material to be dispersed and the vane 220 as well as the inner circumferential surface of the cavity 111, it is preferable that the gap between the distal edge 222 of the vane 220 and the inner circumferential surface of the cavity 111 is equal to or more than 1 mm.

Also, in order to suppress the thermal degradation of the material to be dispersed and/or dispersion due to the frictional heat generated during the dispersing process, and to obtain the dispersion in a desired state such as a molten state or powder state as the case may be, the container unit including the bottom member, the cylindrically shaped wall member and the lid member, the rotating shaft and/or the vane may be provided therein a structure through which a refrigerant such as water or a heating agent can be provided.

In this case, it is preferable to provide at least one of the inside of the member of the container 110 and the inside of the stirring member 200, with a temperature control flow path, and a temperature control mechanism that circulates a heat-transfer fluid through the temperature control flow path (not shown).

Regarding the rotational driving unit that rotates the stirring member 200, the rotating shaft 210 may be directly coupled to a drive shaft of a motor, or connected to the drive shaft of the motor via a gear train or a belt mechanism.

Also, the foregoing embodiment is described on the assumption that the rotating shaft is vertically oriented, the installation orientation of the apparatus according to the present invention is not limited, as long as a laminar flow of a certain speed can be obtained. The apparatus may be installed such that the rotation direction of the rotating shaft becomes parallel, perpendicular, or oblique with respect to the ground.

Further, for introducing the material to be dispersed into the cavity, the lid portion may be opened to introduce the material to be dispersed therethrough, or a device that feeds the material to be dispersed to the cavity, such as a hopper, may be provided (not shown).

Also, in order to take out the dispersion after completing the dispersing process, the lid portion may be opened, or an outlet port may be provided at a bottom portion.

Further, the apparatus according to the present invention may be additionally provided with a depressurizing apparatus for removing the moisture or gas, contained in the material to be dispersed or generated during the dispersing process. Also, an inert gas such as nitrogen gas may be provided, in order to suppress the degradation of the material to be dispersed and the dispersion.

Also, the foregoing embodiment represents an example where a pair of vanes 220 is separately located at two positions spaced by 180 degrees around the axial center of the rotating shaft 210. However, in the dispersing apparatus according to the present invention, it suffices that the vanes are located at an even-number of positions on the outer circumferential surface of the rotating shaft 210 at regular intervals along the rotation direction, and that the odd-numbered vane 220 has an attack angle θ of a negative value and is located at a relatively lower position and the even-numbered vane 220 has an attack angle θ of a positive value and is located at a relatively upper position.

Accordingly, as a dispersing apparatus 300 exemplified in FIGS. 5A to 7, the vanes 220 may be provided at four positions spaced by 90 degrees around the axial center of the rotating shaft 210. In the dispersing apparatus 300, the first vane 220*a*, which is an odd-numbered vane of a stirring member 230, and a third vane 220*c* are located at the same position in the axial direction, and the second vane 220*b* which is an even-numbered vane and a fourth vane 220*d* are located at the same axial position. The odd-numbered vanes 220*a*, 220*c* and the even-numbered vanes 220*b*, 220*d* are located at non-overlapping positions in the axial direction.

The number of the vanes 220 of the stirring member 230 may be determined such that the material to be dispersed forms the laminar flow while being stirred, taking into account the chord length of the vane 220 and the diameter of the rotating shaft 210.

Accordingly, the vanes 220 may be located at six positions spaced by 60 degrees around the axial center of the rotating shaft 210, or at eight positions spaced by 45 degrees, for example (not shown).

Also, as a dispersing apparatus 310 exemplified in FIGS. 8A to 10, the combination of an odd-numbered and an even-numbered vanes 220 may be provided in a plurality of sets, axially of the rotating shaft 210.

On such stirring member 240, the vane 220 is provided at two positions spaced by 180 degrees around the axial center of the rotating shaft 210. However, on a first position, which is an odd-numbered position, two vanes 220*a*, 220*c* are located at an upper and a lower position, while on a second position which is an even-numbered position two vanes 220*b*, 220*d* are located at an upper and a lower position.

In the dispersing apparatus 310 also, the vanes 220*a* to 220*d* are located at non-overlapping positions in the axial direction. Also, the absolute value of the attack angle of the vanes 220*a* to 220*d* is, for example, 15 degrees.

Also, the front edge of a lowermost vane 220 on the odd-numbered position is located close to the bottom surface of the cavity 111, and the front edge of an uppermost vane 220 on the even-numbered position is located close to the ceiling surface of the cavity 111.

Naturally, the number of the vanes 220 to be axially provided on the rotating shaft 210 may also be determined such that the material to be dispersed forms the laminar flow while being stirred, taking into account the chord length of the vane 220 and the attack angle thereof.

Further, a plurality of sets of the vanes 200 located at four or more positions around the axial center of the rotating shaft 210 may be axially aligned (not shown). Increasing the number of such sets easily leads to building a larger-scaled apparatus.

The present inventors actually built a stirring member 240 of the foregoing structure, and tested the effectiveness of the same. The experiment results will be described hereunder, referring to FIGS. 11 to 14.

Figure 11A:
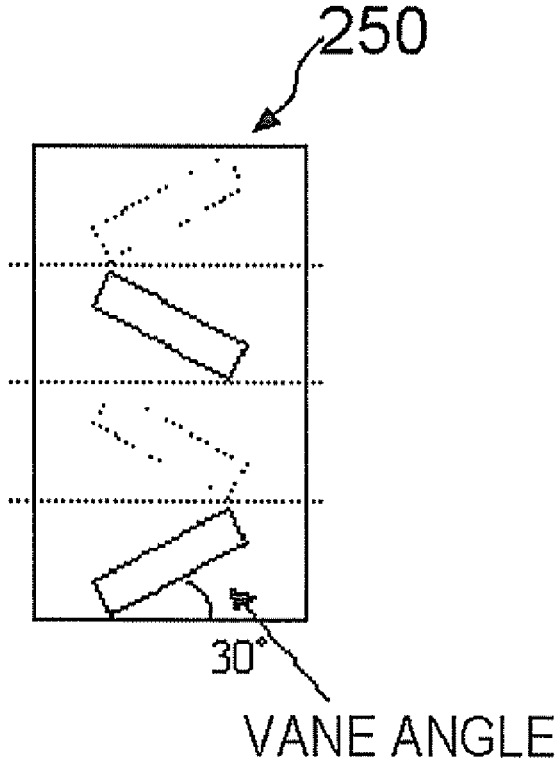
FIGS. 11A and 11B are two-view drawings showing a structure of a stirring member corresponding to a conventional example.
Figure 11B:
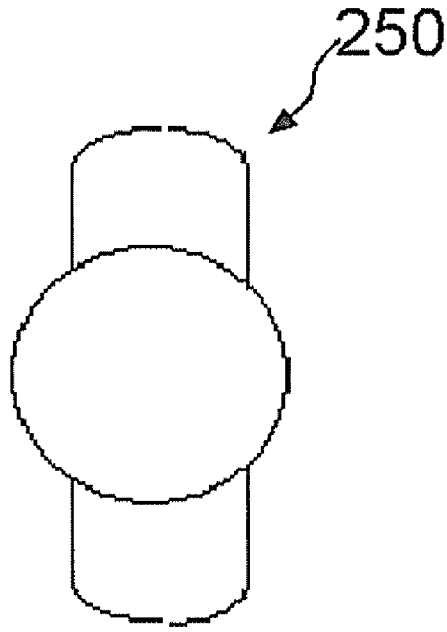
Figure 12A:
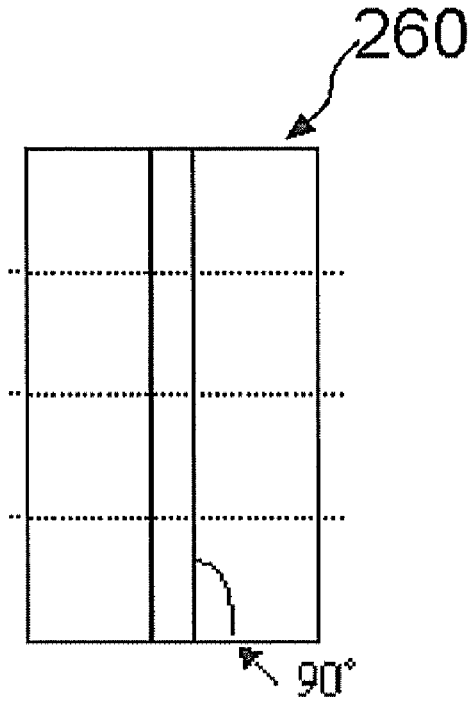
FIGS. 12A and 12B are two-view drawings showing a structure of a stirring member corresponding to a conventional example.
Figure 12B:
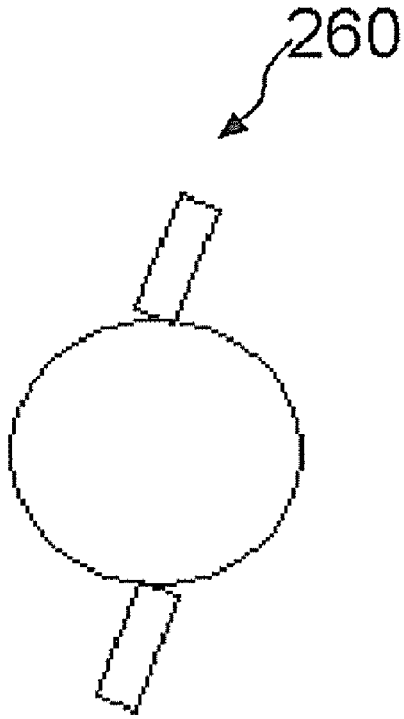
Figure 13A:
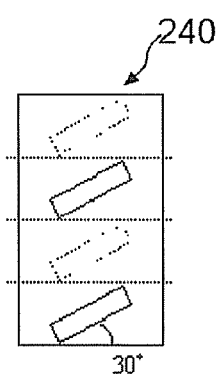
FIGS. 13A and 13B are two-view drawings showing a structure of a test sample of a stirring member.
Figure 13B:
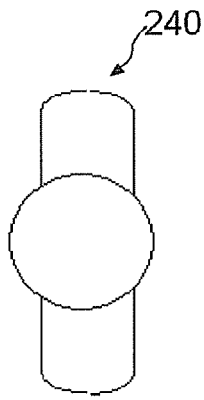

Firstly, as shown in FIGS. 11 to 13, the present inventors experimentally made up three types of stirring members 240 to 260. The present inventors then prepared a container having a cavity inner diameter of 100 mm and vertical length of 57.5 mm (not shown).

In all the stirring members 240 to 260, the vanes are located at two positions spaced by 180 degrees around the axial center of the rotating shaft.

Also, on the stirring member 250, two vanes are located on two positions, an upper and a lower position, on the rotating shaft as the stirring member 240. Those four vanes are located at mutually non-overlapping positions in a vertical direction.

The vertical width A of the vane was set to be 13 mm, and the distance B between the upper edge of an odd-numbered vane 220 and the lower edge of an even-numbered vane 220 was set to be 0 mm. The gap between the distal edge of the vane and inner circumferential surface of the cavity was 5 mm. The gap between the lower edge of a lowermost vane and the bottom surface of the cavity was set to be 2 mm.

In the stirring member 250, however, the attack angle of the lower vane on the first position was set to be −30 degrees and that of the upper vane at +30 degrees, and the attack angle of the lower vane on the second position was set to be −30 degrees and that of the upper vane at +30 degrees.

On the other hand, the stirring member 260 includes a vane at two positions on the rotating shaft, and the attack angle of the vane is 90 degrees. The vertical length of the vane is the same as that of the rotating shaft, and the vanes are inclined by a predetermined angle on a plan view. With the stirring member 260, the gap between the distal edge of the vane and the inner circumferential surface of the cavity was set to be 2 mm. The gap between the lower edge of the vane and the bottom surface of the cavity was set to be 2 mm.

The stirring member 240 includes, as already stated, two vanes located at an upper and a lower position on the first position, which is an odd-numbered position, and two vanes located at an upper and a lower position on the second position, which is an even-numbered position.

Those four vanes are located at mutually non-overlapping positions in a vertical direction. The vertical distance B between the vanes was set to be 0 mm, and the vertical width A of the vane was set to be 13 mm. The gap between the distal edge of the vane and the inner circumferential surface of the cavity was set to be 2 mm.

The gap between the lower edge of a lowermost vane and the bottom surface of the cavity was set to be 2 mm. The attack angle of the first two vanes was respectively set to be −30 degrees, and that of the second two vanes at +30 degrees respectively.

The present inventors employed a transparent glass on an upper portion of the container, and rotated the stirring members 240 to 260 at a plurality of speeds, to thereby actually stir a material to be dispersed. As the material to be dispersed, polyethylene (Petrothene 354 (mechanically crushed) from Tosoh Corporation) was employed.

Figure 14:
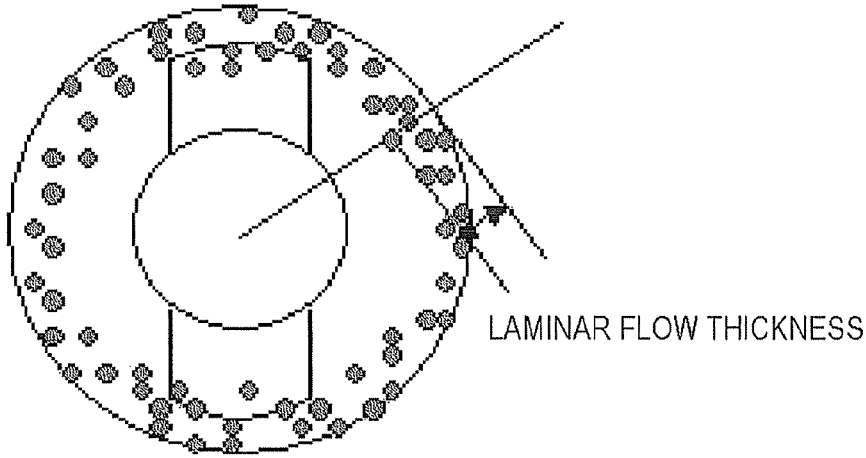
FIG. 14 is a schematic diagram showing a state under an experiment with the stirring member.

Then the thickness of the flow motion was visually observed, as shown in FIG. 14. As a result, the thickness of the flow motion when the circumferential speed of the distal edge of the vane was set to be approx. 24 m/sec was approx. 15 mm with the stirring member 250, approx. 9 mm with the stirring member 260, and approx. 8 mm with the stirring member 240.

Accordingly, it has been confirmed that the stirring member 250 generates a turbulent flow, and that the material to be dispersed does not form a laminar flow while being stirred. Regarding the stirring members 240, 260, it has been confirmed that, although the both create the laminar flow of the material to be dispersed, the stirring member 240 more stably creates a thinner laminar flow.

It should be noted that the same result was obtained upon changing the rotation speed. In other words, it has been confirmed that the stirring member 250 failed to create a satisfactory laminar flow, while the stirring member 240 is capable of effectively creating the laminar flow irrespective of the circumferential speed of the distal edge.

As stated above, when the flow motion is thinner, the laminar flow can be effectively created, without generating the turbulent flow. Effectively forming the laminar flow allows preventing the degradation of the material to be dispersed originating from excessive frictional heat.

The present inventors then made an experiment on the degree of mixture of the material to be dispersed, with respect to the stirring members 240 to 260. As the material to be dispersed, 24.5 g of bengara (average particle diameter 50 nm), 3.5 g of light calcium carbonate (average particle diameter 20 nm), and 1.4 g of zinc stearate were prepared.

Then the mixture of those materials, serving as the material to be dispersed, was stirred for one minute by the stirring members 240 to 260 at a plurality of circumferential speeds, and the degree of mixture was evaluated based on color saturation. Here, the evaluation by color saturation will be briefly described.

Firstly, a predetermined portion of the respective mixture stirred by the stirring members 240 to 260 was collected and pressurized, to thereby form a flat plate of 3 mm in thickness. The flat plate was then subjected to colorimetry by a color difference meter Macbeth CE7000, according to JIS K 5600-4-5. The color saturation was displayed according to JIS Z 8729.

As a result, the color saturation obtained under the circumferential speed of the distal edge of the vane of approx. 24 m/sec was approx. 2.7 with the stirring member 250, approx. 2.6 with the stirring member 260, and approx. 3.8 with the stirring member 240.

In this case, the higher color saturation indicates that the material to be dispersed has been more desirably dispersed. Accordingly, it has been confirmed that the stirring member 240 has achieved a prominently excellent degree of mixture. It has also been confirmed that such advantage is prominent especially when the circumferential speed is slower.

In view of the foregoing experiment results, it has proved that, irrespective of the circumferential speed, the stirring member 240 provides highest performance of effectively forming the laminar flow. In the aspect of the degree of mixture also, the stirring member 240 exhibited best performance irrespective of the circumferential speed. Consequently, the stirring member 240 is capable of effectively mixing the material to be dispersed irrespective of the rotation speed, without incurring degradation.

Also, the present inventors made up a stirring member (not shown) of a similar structure to that of the stirring member 240 but with the attack angle of the vane set to be ±10 degrees, so that the vertical width A of the vane was set to be 6 mm and the vertical distance B at 6 mm.

Then it has been confirmed that such stirring member is unable to effectively disperse the material to be dispersed. In other words, it has been confirmed that a structure in which the vertical width A of the vane and the vertical distance B are equal cannot effectively disperse the material to be dispersed.

Further, the present inventors made up a stirring member (not shown) including eight vanes located at two positions spaced by 180 degrees in upper and lower four levels, and another stirring member (not shown) including eight vanes located at four positions spaced by 90 degrees in upper and lower two levels.

In these stirring members also, the vanes were located at mutually non-overlapping positions, and attached such that the vertical distance B became 0 mm and the vertical width A of the vane became 6 mm. Also, the attack angle of the vane was set to be ±10 degrees. As a result, it has been confirmed that these stirring members can also effectively stir the material to be dispersed in the laminar flow.

Now, description will be given on a method of manufacturing, utilizing the dispersing apparatus according to the present invention and employing a polymer and an additive as the material to be dispersed, a dispersion in which the additive is uniformly and finely dispersed in the polymer serving as the dispersion medium.

The polymer and the additive, which are the material to be dispersed, are introduced into the cavity of the dispersing apparatus according to the present invention, and the rotating shaft is caused to rotate to thereby stir the material to be dispersed, with the circumferential speed of the distal edge of the vane adjusted in a range of equal to or faster than 10 m/sec and equal to or slower than 200 m/sec.

Upon forming the desired dispersed state, the dispersion is taken out. The stirring action performed therein constitutes the laminar flow, to thereby apply a regular and uniform force to the material to be dispersed, i.e. the polymer and the additive, and resultantly a uniform and fine dispersion can be efficiently obtained.

In the present invention, the type of polymers that can be employed as the dispersion medium in the material to be dispersed is not specifically determined, however it is preferable to employ a resin the glass transition temperature of which is equal to or higher than −50° C., particularly a thermoplastic resin.

Typical examples include polypropylene, polyethylene, polyester, polycarbonate, polymethyl methacrylate, polystyrene, polyamide, polysulfone, polyether etherketone, polyoxymethylene, polyimide, polyurethane, polysaccharide, poly(N-vinylpyrolidone), and a copolymer thereof.

A high hydrogen bonding resin containing 20 to 60 wt % of hydrogen bonding group or ionic group with respect to the resin unit weight can also be cited as a specific example. Examples of the hydrogen bonding group of the high hydrogen bonding resin include a hydroxyl group, an amino group, a thiol group, a carboxyl group, a sulfonic acid group, and a phosphoric acid group, and examples of the ionic group include a carboxylate group, a sulfonic acid ion group, and an ammonium group. More specifically, polyvinyl alcohol, an ethylene-vinyl alcohol copolymer containing 41 mol % or more of vinyl alcohol, polyacrylic acid, sodium polyacrylate, polybenzene sulfonic acid, polyallylamine, polyglycerin and so on can be cited.

Also, polysaccharide and protein are also included in the examples of the polymer. The polysaccharide is a biopolymer synthesized in a biological system through polycondensation of various monosaccharides, however herein the biopolymer that is chemically modified is also included.

Examples of the polysaccharide include starches such as wheat starch, corn starch and potato starch, hydroxymethyl cellulose, hydroxyethyl cellulose, carboxymethyl cellulose, hydroxypropyl cellulose, hydroxypropylmethyl cellulose, amylose, amylopectin, pullulan, curdlan, xanthan, chitin, chitosan, and cellulose. As an example of the protein, zein from corn protein can be cited.

In the material to be dispersed, the additive dispersed in the polymer serving as the dispersion medium may be a polymer compound, an inorganic substance and/or a low molecular weight organic compound. Examples of the polymer compound that may be employed as the additive include one or more of the foregoing polymers, polymer liquid crystal, a polymer medicine, and DNA.

Examples of the inorganic substance that may be employed as the additive include a layered clay mineral, a metal and an oxide thereof, carbon (graphite, carbon nanotube, carbon nanohorn, and fullerenes), and an inorganic pigment, and it is more preferable that the shape of such substance is not a large mass that impedes the stirring motion, and may be any desired form such as a fiber, spherical particle or scale.

Examples of the low molecular weight organic compound include a phthalocyanine-, azo-, anthraquinone-, quinacridone- or perylene-based pigment or dyestuff, a plasticizer such as long chain ester, a mold release agent such as phosphoric acid ester, an anti-oxidant agent, a UV absorber, a medicine, amino acid, DNA, protein and a fragment thereof, and may be a solid or non-volatile liquid.

Also, according to the present invention, a surfactant, a lubricant or the like may be employed as the case may be, to further improve the dispersibility. An anionic, cathionic and non-ionic surfactant may be employed, among which the anionic and the non-ionic surfactant are preferable for dispersing a pigment.

Examples of the anionic surfactant include carboxylic acid salt, sulfuric acid ester salt, sulfonic acid salt, and phosphoric acid ester salt, and higher fatty acid metal salt such as stearic acid metal salt may be preferably cited as the carboxylic acid salt, and higher alcohol sulfuric acid ester sodium salt, sulfonic acid salt, and higher alkylether sulfuric acid ester salt may be preferably cited as the sulfuric acid ester salt.

Examples of the non-ionic surfactant include a polyethylene glycol type and a polyhydric alcohol type, and the former specifically includes a higher alcohol ethylene oxide family, an alkylphenol ethylene oxide family, a fatty acid ethylene oxide family, a polyhydric alcohol fatty acid ester ethylene oxide family, a higher alkylamine ethylene oxide family, a fatty acid ester ethylene oxide family, and a polypropylene glycol ethylene oxide family.

Specific examples of the polyhydric alcohol type include glycerol fatty acid ester, pentaerythritol fatty acid ester, sorbitol and sorbitan fatty acid ester, sucrose fatty acid ester, polyhydric alcohol alkylether, and alkanolamine family fatty acid amide, and preferably a sorbitan ester family, a polyhydric alcohol fatty acid ester ethylene oxide family, sucrose fatty acid ester, a polyoxy alkylether family, a polyoxyalkylene ester family, a polyoxyethylene sorbitan ester family, a glycerin ester family, and a polyoxyalkylene fatty acid ester family may be cited.

An inorganic layer compound that swells or cleaves in a solvent may be employed as the additive, among which a clay mineral having high swelling property is preferable. Specific examples include kaolinite, dickite, nacrite, halloysite, antigorite, crysotile, pyrophylite, montmorillonite, hectorite, tetracyrillic mica, sodium taeniolite, muscovite, margarite, tulc, vermiculite, phlogopite, xanthophylite, and chlorite.

The foregoing inorganic layer compounds may be swollen, and although the solvent to be employed for swelling is not specifically determined, it is preferable to employ, for swelling a natural swelling clay mineral for example, water, alcohol such as methanol, ethanol, propanol, isopropanol, ethylene glycol or diethylene glycol, dimethyl formamide, dimethylsulfoxide, or acetone, among which water or alcohol such as methanol is preferable.

The dispersion obtained through the manufacturing method according to this embodiment is more uniform and finer, when compared with a dispersion obtained through the conventional dispersing technique. The dispersion based on the present invention may be superior in transparency, because of the improved uniform dispersibility.

Also, the improved uniform dispersibility may lead to upgraded mechanical characteristic, such as modulus of elasticity. Further, a dispersion composed of a crystalline polymer such as propylene or polyethylene and a nucleating agent starts to crystallize at a temperature higher than in the conventional process by 3 degrees or more because of the improved uniform dispersibility, thereby greatly contributing to shortening the formation cycle. In the field of medical drug manufacturing, the present invention can be applied to improvement in drug solubility and suppression of elusion, by uniformly and finely dispersing the drug in a drug carrier.

In the foregoing passages the method of dispersing an additive in a dispersion medium has been described, whereas the dispersing apparatus according to the present invention also excellently serves as a crusher when employed for crushing a solid substance, because the apparatus is capable of constantly applying a uniform force. Further, the dispersing apparatus can process uneven and angular powder into uniform spherical particles, thereby improving fluidity.

Working Example

The present invention will now be described in further details based on working examples, however the present invention is not limited to these specific examples. Here, the dispersing apparatus (not shown) employed in the following working examples includes a similar structure to that of the stirring member 240 shown in FIG. 13 and the like.

In other words, the employed stirring member includes four vanes located at two positions spaced by 180 degrees in upper and lower two levels. The four vanes are located at mutually non-overlapping positions in a vertical direction.

The vertical distance B between those vanes was set to be 0 mm, and the vertical width A of the vane was set to be 10 mm. The attack angle of the first two vanes was respectively set to be −20 degrees, and that of the second two vanes at +20 degrees, respectively.

Also, the inner diameter of the cavity of the container was set to be 100 mm. The vertical length of the cavity was set to be 57.5 mm. The gap between the distal edge of the vane and the inner circumferential surface of the cavity was set to be 2 mm. The gap between the lower edge of a lowermost vane and the bottom surface of the cavity was set to be 2 mm. Then, the rotation speed of the stirring member was set at 5400 rpm.

1. Polyethylene

Nucleating Agent Dispersion

Working Example 1

99.9 wt % of low-density polyethylene (F522N from Ube-Maruzen Polyethylene Co., Ltd., pellet of 3 mm in diameter), density 0.922 g/cm$^3$, MFR (melt flow rate) value 5 g/10 min (according to JIS K-7210), softening temperature 100.2° C. (according to JIS K-7206), and 0.1 wt % of sodium 2,2'-methylene-bis(4,6-ditert-butylphenyl)phosphate (ADEKASTAB (registered trademark) NA-11 from ADEKA CORPORATION) were stirred in the dispersing apparatus made up according to the foregoing embodiment, for 34 seconds at a circumferential speed of 27 m/sec at room temperature, to thereby obtain a low-density polyethylene resin compound.

[Evaluation Test of Uniform Dispersibility and Mechanical Properties]

[Transparency]

A specimen of the obtained polyethylene resin compound of 1 mm in thickness was measured according to JIS-K-7136-1, by a direct-reading haze meter from Toyo Seiki Seisakusho, Ltd., and evaluated based on the haze value.

[Evaluation Test of Uniform Dispersibility]

An inflation film of 50 μm in thickness was prepared from the obtained polyethylene resin compound, and the number of aggregations of 0.1 mm$^2$ or larger on the film of 100 cm$^2$ in area was counted.

The aggregation originates from defective dispersion of the nucleating agent and/or degradation of the polyethylene resin in the polyethylene resin compound. With respect to the counting result, the uniform dispersibility was evaluated according to the following criteria.

AA: Less than 10, and uniform dispersibility is sufficient.

BB: 10 or more and less than 30, and the uniform dispersibility is rather inferior and may be inappropriate for use as a thin product such as a film.

CC: 30 or more, and uniform dispersibility is unsatisfactory.

[Measurement of Young's Modulus]

A tensile testing machine, type 201B from INTESCO Co., Ltd. was employed for measurement, at a tensile speed of 50 mm/min according to JIS 7721.

[Evaluation of Formation Cycle: Measurement of Crystallization Temperature]

A differential scanning calorimeter, type DSC-7 from PerkinElmer Japan Co., Ltd. was employed, to heat the material of 1 mg from 30° C. to 180° C. at a rate of 20° C./min, to retain the material at 180° C. for 1 minute, and to cool the material at a rate of 20° C./min. Then the temperature at which heat generation has started was taken as the crystallization temperature, which was utilized as the index for formation cycle evaluation.

[Evaluation of Improvement Effect in Uniform Dispersibility and Mechanical Properties, and Increase in Crystallization Temperature]

The crystallization temperature, transparency, uniform dispersibility, and Young's modulus of the polyethylene resin compound from the working example 1 are shown in Table 1.

In comparison with the haze value: 92.6, Young's modulus: 110.6 MPa, and crystallization temperature: 92.9° C. of the original low-density polyethylene, the obtained polyethylene resin compound exhibits a lower haze value, higher Young's modulus, crystallization temperature, and barely shows the aggregations, and therefore it is understood that the nucleating agent has been quite uniformly dispersed in the polyethylene resin, thereby improving the mechanical properties such as rigidity, as well as the transparency, and significantly increasing the crystallization temperature.

In view of the properties data shown in Table 1, it is understood that the dispersing apparatus according to this working example is capable of providing uniform dispersibility to the polyethylene resin compound to be produced, thereby upgrading the characteristic of the polyethylene resin.

Working Examples 2 to 9

As shown in Table 1, the same low-density polyethylene as that of the working example 1 was employed, but the type and concentration of the nucleating agent and the circumferential speed were changed. The same dispersing apparatus as that of the working example 1 was employed with the remaining conditions unchanged, to thereby obtain the low-density polyethylene resin compound through a similar manufacturing process. The properties of such compound are shown in Table 1.

Comparative Example 1

A Brabender mixer (Labo Plastomill from Toyo Seiki Seisakusho, Ltd.) was employed to melt and knead the whole quantity of the same material as that of the working example 3, at the temperature of 125° C. for 5 minutes at a speed of 60 rpm, to thereby obtain a low-density polyethylene resin compound.

Comparative Example 2

Utilizing the same material as that of the working example 5, a low-density polyethylene resin compound was obtained through the same manufacturing process as that of the comparative example 1.

[Evaluation of Improvement in Uniform Dispersibility and Mechanical Properties, and Increase in Crystallization Temperature]

In comparison with the original low-density polyethylene resin, the low-density polyethylene resin compounds from the working examples 2 to 9 exhibit, as shown in Table 1, higher Young's modulus, lower haze values and higher crystallization temperature, and barely show the aggregations, and therefore it is understood that the nucleating agent has been quite uniformly dispersed, thereby improving the mechanical properties such as rigidity, as well as the transparency, and increasing the crystallization temperature. It is also understood that the uniform dispersibility can be maintained despite changing the quantity of the nucleating agent, stirring time and circumferential speed, in a predetermined range.

On the other hand, although the low-density polyethylene resin compound from the comparative examples 1 and 2 show a certain increase in crystallization temperature, significant improvement in haze value is not observed, with a lean increase in Young's modulus and greater number of aggregations, from which it is understood that the characteristic of the polyethylene resin has been degraded and the dispersibility has proved to be unsatisfactory.

TABLE 1

| | | NUCLEATING AGENT | | CIRCUMFERENTIAL STIRRING | | |
|---|---|---|---|---|---|---|
| | POLYETHYLENE RESIN | TYPE | CONCENTRATION wt % | STIRRING TIME (SEC) | SPEED (m/s) | TEMPERATURE (° C.) |
| | LDPE (F522N) | NUCLEATING AGENT NOT ADDED | | — | — | — |
| WORKING EXAMPLE 1 | | NA-11 | 0.1 | 34 | 27 | ROOM TEMPERATURE |
| WORKING EXAMPLE 2 | | | 0.2 | 28 | 35 | ROOM TEMPERATURE |
| WORKING EXAMPLE 3 | | | 0.3 | 29 | 27 | ROOM TEMPERATURE |
| WORKING EXAMPLE 4 | | GEL-ALL MD | 0.1 | 25 | 40 | ROOM TEMPERATURE |
| WORKING EXAMPLE 5 | | | 0.2 | 32 | 27 | ROOM TEMPERATURE |
| WORKING EXAMPLE 6 | | | 0.3 | 30 | 27 | ROOM TEMPERATURE |
| WORKING EXAMPLE 7 | | AL-PTBBA | 0.1 | 33 | 27 | ROOM TEMPERATURE |
| WORKING EXAMPLE 8 | | | 0.2 | 32 | 27 | ROOM TEMPERATURE |
| WORKING EXAMPLE 9 | | | 0.3 | 20 | 55 | ROOM TEMPERATURE |
| COMPARATIVE EXAMPLE 1 | | NA-11 | 0.3 | BY LABO PLASTOMILL 125° C., 5 MINUTES, 60 rpm | | |
| COMPARATIVE EXAMPLE 2 | | GEL-ALL MD | 0.2 | | | |

TABLE 1-continued

| | CRYSTALLIZATION TEMPERATURE (° C.) | TRANSPARENCY (HAZE VALUE) | UNIFORM DISPERSIBILITY | YOUNG'S MODULUS (MPa) |
|---|---|---|---|---|
| | 92.9 | 92.6 | AA | 110.6 |
| WORKING EXAMPLE 1 | 97.6 | 37.9 | AA | 121.7 |
| WORKING EXAMPLE 2 | 98.0 | 30.2 | AA | 121.8 |
| WORKING EXAMPLE 3 | 98.2 | 26.7 | AA | 121.8 |
| WORKING EXAMPLE 4 | 98.4 | 27.2 | AA | 113.2 |
| WORKING EXAMPLE 5 | 98.2 | 29.3 | AA | 113.1 |
| WORKING EXAMPLE 6 | 97.7 | 61.6 | AA | 111.1 |
| WORKING EXAMPLE 7 | 96.0 | 65.5 | AA | 115.1 |
| WORKING EXAMPLE 8 | 96.2 | 55.3 | AA | 118.3 |
| WORKING EXAMPLE 9 | 96.5 | 53.3 | AA | 120.4 |
| COMPARATIVE EXAMPLE 1 | 95.2 | 79.5 | CC | 112.1 |
| COMPARATIVE EXAMPLE 2 | 96.5 | 80.4 | BB | 110.0 |

LDPE (F522N): Low-density polyethylene from Ube-Maruzen Polyethylene Co., Ltd.
NA-11: Nucleating agent ADEKASTAB NA-11, sodium 2,2'-methylene-bis(4,6-ditert-butylphenyl)phosphate from ADEKA CORPORATION
Gel-All MD: Nucleating agent from New Japan Chemical Co., Ltd., bis(4-methylbenzylidene)sorbitol
AL-PTBBA: Nucleating agent 4-tert-butyl aluminum benzoate salt, from Dainippon Ink & Chemicals, Inc.

[Preparation of a Nucleating Agent Master Batch]

To 95 wt % of low-density polyethylene (Mirason 11P from Prime Polymer Co., Ltd., pellet of 3 mm diameter), density 0.917 g/cm$^3$, MFR value 5 g/10 min, softening temperature 100.2° C., 5 wt % of sodium 2, 2'-methylene-bis(4, 6-ditert-butylphenyl)phosphate (ADEKA STAB NA-11 from ADEKA CORPORATION) was added, and the same dispersing apparatus as that of the working example 1 was employed to stir the mixture at a circumferential speed 27 m/sec for 28 seconds at room temperature, to thereby obtain the master batch of the nucleating agent ADEKASTAB NA-11.

Through the similar process but with different types of nucleating agent, the master batches of the nucleating agents bis(4-methylbenzylidene)sorbitol (Gel-All MD from New Japan Chemical Co., Ltd.) and 4-tert-butyl aluminum benzoate salt (AL-PTBBA from Dainippon Ink & Chemicals, Inc.) were prepared.

Working Example 10

2 wt % of the nucleating agent master batch of ADEKASTAB NA-11 prepared as above was added to 98 wt % of linear low-density polyethylene (IDEMITSU-LL 0234H from Prime Polymer Co., Ltd., pellet of 3 mm diameter), density 0.919 g/cm$^3$, MFR value 2 g/10 min, softening temperature 117° C., and the same dispersing apparatus as that of the working example 1 was employed to stir the mixture at a circumferential speed 27 m/sec for 44 seconds at room temperature, to thereby obtain a linear low-density polyethylene resin compound. The properties of the compound are shown in Table 2.

Working Examples 11 to 17

As shown in Table 2, the same linear low-density polyethylene resin as that of the working example 10 was employed, and the type and concentration of the nucleating agent master batch, the stirring time and the circumferential speed were changed. With the remaining conditions unchanged, low-density polyethylene resin compounds were obtained through a similar manufacturing process to that of the working example 10. The properties of such compounds are shown in Table 2.

Comparative Example 3

The same material as that of the working example 16 was stirred under the condition shown in Table 2, to thereby obtain a linear low-density polyethylene resin compound.

Comparative Example 4

The same material as that of the working example 11 was stirred under the condition shown in Table 2, to thereby obtain a linear low-density polyethylene resin compound.

[Evaluation of Improvement in Uniform Dispersibility and Mechanical Properties, and Increase in Crystallization Temperature]

As shown in Table 2, it is understood that, in comparison with the original linear low-density polyethylene resin, the linear low-density polyethylene resin compounds from the working examples 10 to 17 exhibit higher Young's modulus, lower haze values, and higher crystallization temperature with scarce aggregations, however in the case where the circumferential speed and stirring temperature deviating from a predetermined range were applied as the comparative examples 3 and 4, the employed polyethylene resin is degraded and the uniform dispersibility of the nucleating agent is lowered, which leads to increased number of aggregations and to invisible or poor, if any, improvement in transparency and mechanical properties.

TABLE 2

| | POLYETHYLENE RESIN | NUCLEATING AGENT TYPE | NUCLEATING AGENT CONCENTRATION wt % | CIRCUMFERENTIAL STIRRING STIRRING TIME (SEC) | SPEED (m/s) | TEMPERATURE (° C.) |
|---|---|---|---|---|---|---|
| | LLDPE (0234H) | NUCLEATING AGENT NOT ADDED | | — | — | — |
| WORKING EXAMPLE 10 | | NA-11 | 0.1 | 44 | 27 | ROOM TEMPERATURE |
| WORKING EXAMPLE 11 | | | 0.2 | 43 | 27 | ROOM TEMPERATURE |
| WORKING EXAMPLE 12 | | | 0.3 | 41 | 27 | ROOM TEMPERATURE |
| WORKING EXAMPLE 13 | | GEL-ALL MD | 0.1 | 44 | 27 | ROOM TEMPERATURE |
| WORKING EXAMPLE 14 | | | 0.2 | 42 | 27 | ROOM TEMPERATURE |
| WORKING EXAMPLE 15 | | | 0.3 | 20 | 75 | ROOM TEMPERATURE |
| WORKING EXAMPLE 16 | | AL-PTBBA | 0.2 | 42 | 27 | ROOM TEMPERATURE |
| WORKING EXAMPLE 17 | | | 0.3 | 30 | 40 | ROOM TEMPERATURE |
| COMPARATIVE EXAMPLE 3 | | AL-PTBBA | 0.2 | 10 | 205 | ROOM TEMPERATURE |
| COMPARATIVE EXAMPLE 4 | | NA-11 | 0.2 | 20 | 27 | 120 |

| | CRYSTALLIZATION TEMPERATURE (° C.) | TRANSPARENCY (HAZE VALUE) | UNIFORM DISPERSIBILITY | YOUNG'S MODULUS (MPs) |
|---|---|---|---|---|
| | 100.8 | 82.8 | AA | 188.8 |
| WORKING EXAMPLE 10 | 106.1 | 58.9 | AA | 199.9 |
| WORKING EXAMPLE 11 | 108.7 | 46.1 | AA | 200.3 |
| WORKING EXAMPLE 12 | 109.1 | 45.3 | AA | 200.3 |
| WORKING EXAMPLE 13 | 110.3 | 38.1 | AA | 194.0 |
| WORKING EXAMPLE 14 | 112.0 | 47.0 | AA | 195.2 |
| WORKING EXAMPLE 15 | 112.6 | 50.6 | AA | 195.6 |
| WORKING EXAMPLE 16 | 105.0 | 67.0 | AA | 190.1 |
| WORKING EXAMPLE 17 | 104.2 | 59.9 | AA | 192.0 |
| COMPARATIVE EXAMPLE 3 | 101.5 | 86.2 | CC | 180.2 |
| COMPARATIVE EXAMPLE 4 | 102.4 | 78.5 | CC | 175.0 |

LLDPE (0234H): Linear low-density polyethylene from Prime Polymer Co., Ltd.

Working Example 18

2 wt % of nucleating agent master batch of ADEKASTAB NA-11 prepared as above was added to 98 wt % of metallocen linear low-density polyethylene (Evolue SP0540 from Prime Polymer Co., Ltd., pellet of 2.5 mm diameter), density 0.905 g/cm$^3$, MFR value 4 g/10 min, softening temperature 83° C., and the same dispersing apparatus as that of the working example 1 was employed to stir the mixture at a circumferential speed 27 m/sec for 22 seconds at room temperature, to thereby obtain a metallocen linear polyethylene resin compound. The properties of the compound are shown in Table 3.

Working Examples 19 to 27

As shown in Table 3, the same metallocen linear low-density polyethylene resin as that of the working example 18 was employed, and the type and concentration of the nucleating agent master batch, the stirring time and the circumferential speed were changed. With the remaining conditions unchanged, metallocen linear low-density polyethylene resin compounds were obtained through a similar manufacturing process to that of the working example 18. The properties of such compounds are shown in Table 3.

Comparative Example 5

The same material as that of the working example 20 was stirred under the condition shown in Table 3, to thereby obtain a metallocen linear low-density polyethylene resin compound.

Comparative Examples 6 to 8

A Brabender mixer (Labo Plastomill from Toyo Seiki Seisakusho, Ltd.) was employed to melt and knead the whole quantity of the material shown in Table 3, at the temperature of 125° C. for 5 minutes at a speed of 60 rpm, to thereby obtain a metallocen linear low-density polyethylene resin compound.

[Evaluation of Improvement in Uniform Dispersibility and Mechanical Properties, and Increase in Crystallization Temperature]

As shown in Table 3, it is understood that, in comparison with the original metallocen linear low-density polyethylene resin, the metallocen linear low-density polyethylene resin compounds from the working examples 18 to 27 exhibit higher Young's modulus, lower haze values and scarce aggregations, and significant increase in crystallization temperature as much as approx. 14° C. at the lowest and even 20° C. or more on the higher side, however under a circumferential speed deviating from the predetermined range as the comparative example 5, or when molten and kneaded through the conventional process as the comparative examples 6 to 8, the uniform dispersibility and/or characteristic of the nucleating agent with respect to the employed metallocen linear polyethylene resin is degraded, which leads to greater number of aggregations and to invisible or poor, if any, improvement in transparency and mechanical properties.

TABLE 3

| | POLYETHYLENE RESIN | NUCLEATING AGENT TYPE | NUCLEATING AGENT CONCENTRATION wt % | STIRRING TIME (SEC) | CIRCUMFERENTIAL SPEED (m/s) | STIRRING TEMPERATURE (° C.) |
|---|---|---|---|---|---|---|
| | METALLOCEN | NUCLEATING AGENT NOT ADDED | | — | — | — |
| WORKING EXAMPLE 18 | LLDPE (SP0540) | NA-11 | 0.1 | 22 | 27 | ROOM TEMPERATURE |
| WORKING EXAMPLE 19 | | | 0.05 | 22 | 27 | ROOM TEMPERATURE |
| WORKING EXAMPLE 20 | | | 0.2 | 22 | 27 | ROOM TEMPERATURE |
| WORKING EXAMPLE 21 | | | 0.3 | 21 | 27 | ROOM TEMPERATURE |
| WORKING EXAMPLE 22 | | GEL-ALL MD | 0.1 | 23 | 27 | ROOM TEMPERATURE |
| WORKING EXAMPLE 23 | | | 0.2 | 22 | 27 | ROOM TEMPERATURE |
| WORKING EXAMPLE 24 | | | 0.3 | 23 | 27 | ROOM TEMPERATURE |
| WORKING EXAMPLE 25 | | AL-PTBBA | 0.1 | 22 | 27 | ROOM TEMPERATURE |
| WORKING EXAMPLE 26 | | | 0.2 | 21 | 27 | ROOM TEMPERATURE |
| WORKING EXAMPLE 27 | | | 0.3 | 15 | 35 | ROOM TEMPERATURE |
| COMPARATIVE EXAMPLE 5 | | NA-11 | 0.2 | 20 | 10 | ROOM TEMPERATURE |
| COMPARATIVE EXAMPLE 6 | | NA-11 | 0.2 | BY LABO PLASTOMILL 125° C., 5 MINUTES, 60 rpm | | |
| COMPARATIVE EXAMPLE 7 | | GEL-ALL MD | 0.1 | | | |
| COMPARATIVE EXAMPLE 8 | | AL-PTBBA | 0.3 | | | |

| | CRYSTALLIZATION TEMPERATURE (° C.) | TRANSPARENCY (HAZE VALUE) | UNIFORM DISPERSIBILITY | YOUNG'S MODULUS (MPa) |
|---|---|---|---|---|
| | 90.0 | 77.4 | AA | 106.9 |
| WORKING EXAMPLE 18 | 108.8 | 39.7 | AA | 124.5 |
| WORKING EXAMPLE 19 | 108.2 | 43.5 | AA | 123.2 |
| WORKING EXAMPLE 20 | 109.9 | 41.9 | AA | 139.7 |
| WORKING EXAMPLE 21 | 111.0 | 37.6 | AA | 143.1 |
| WORKING EXAMPLE 22 | 104.2 | 43.6 | AA | 114.4 |
| WORKING EXAMPLE 23 | 110.8 | 49.6 | AA | 124.4 |
| WORKING EXAMPLE 24 | 111.0 | 54.2 | AA | 124.7 |
| WORKING EXAMPLE 25 | 103.8 | 47.2 | AA | 140.0 |
| WORKING EXAMPLE 26 | 105.0 | 39.7 | AA | 143.9 |
| WORKING EXAMPLE 27 | 105.6 | 47.2 | AA | 148.1 |
| COMPARATIVE EXAMPLE 5 | 100.0 | 80.0 | CC | 105.4 |
| COMPARATIVE EXAMPLE 6 | 104.1 | 85.0 | CC | 110.4 |

TABLE 3-continued

| | | | | |
|---|---|---|---|---|
| COMPARATIVE EXAMPLE 7 | 95.7 | 81.4 | BB | 102.3 |
| COMPARATIVE EXAMPLE 8 | 96.5 | 91.2 | CC | 106.0 |

Metallocen LLDPE (SP0540): Metallocen linear low-density polyethylene from Prime Polymer Co., Ltd.

2. Medical Drug Manufacturing

Working Example 28

9 weight part of low-density polyethylene (F522N from Ube-Maruzen Polyethylene Co., Ltd., pellet of 3 mm in diameter), crushed (average particle diameter 400 μm), and 1 weight part of furosemide, average particle diameter 4 μm (from Wako Pure Chemical Industries, Ltd.) were stirred in the same dispersing apparatus as that of the working example 1, at a circumferential speed of 21 m/sec for 3 minutes at room temperature, to thereby obtain a dispersion of furosemide and polyethylene.

Working Examples 29 and 30

As shown in Table 4, the same material as that of the working example 28 was employed in the same weight ratio, and stirred at the same circumferential speed in the same dispersing apparatus at room temperature, but during different stirring times, to thereby obtain a dispersion of furosemide and polyethylene.

Comparative Example 9

As shown in Table 4, the same material as that of the working example 28 was employed in the same weight ratio, and introduced into a polyethylene bag and manually shaken for mixing for 5 minutes at room temperature, to thereby obtain a physical mixture of a drug and a polymer.

[Evaluation Test of Drug Dispersibility]

Predetermined quantities of the drug-polymer dispersions from the working examples 28 to 30, and the physical mixture from the comparative example 9 were respectively weighed, dipped in acetone for a day and night, ultrasonically cleaner for 3 minutes by an ultrasonic cleaner and filtered, and then the insoluble matter was cleaned in acetone 5 times.

The insoluble matter thus obtained was pressed at 200° C. to form into a film, and the furosemide contained therein was quantified by a FT-IR spectrophotometer from PerkinElmer Japan Co., Ltd. with the absorption of 3285 $cm^{-1}$ which is the characteristic absorption of the furosemide, to thereby calculate the survival rate of the furosemide. The result is shown in Table 4.

TABLE 4

| | STIRRING TIME (MN) | CIRCUMFERENTIAL SPEED (m/s) | DRUG SURVIVAL wt % |
|---|---|---|---|
| WORKING EXAMPLE 28 | 3 | 21 | 50 |
| WORKING EXAMPLE 29 | 10 | 21 | 80 |
| WORKING EXAMPLE 30 | 30 | 21 | 85 |
| COMPARATIVE EXAMPLE 9 | MANUAL SHAKING 5 MINUTES | — | 0 |

Drug material used: furosemide (from Wako Pure Chemical Industries, Ltd.)

Polymer: Low-density polyethylene (F522N from Ube-Maruzen Polyethylene Co., Ltd.)

Drug/polymer=1/9 (weight part).

According to Table 4, in the case of the physical mixture simply manually shaken for mixing as the comparative example 9, the furosemide which is the drug only remains on the surface of the polymer without intruding inside for dispersion, and is hence easily cleaned off by acetone. In contrast, it is understood that in the case of the working examples 28 to 30, the furosemide intrudes and is dispersed inside the polyethylene particles, the polymer, and therefore at least a part thereof remains inside the polyethylene though cleaned by acetone, and the remaining quantity increases as the processing time is extended, such that after the process of 30 minutes a majority of the drug remains in the polyethylene, which is the polymer.

Working Example 31

9 weight part of hydroxypropyl cellulose (HPCL-type from Nippon Soda Co., Ltd.), average particle diameter 30 μm, and 1 weight part of furosemide, average particle diameter 4 μm (from Wako Pure Chemical Industries, Ltd.) were stirred in the same dispersing apparatus as that of the working example 1, at a circumferential speed of 21 m/sec for 1 minute at room temperature, to thereby obtain a dispersion of furosemide and HPC.

Working Examples 32 to 34

The same material as that of the working example 31 was employed in the same weight ratio, and stirred at the same circumferential speed in the same dispersing apparatus at room temperature, but changing the stirring time to 3 minutes (working example 32), 10 minutes (working example 33), and 30 minutes (working example 34), to thereby obtain a polymer-drug dispersion.

A predetermined quantity of the drug-polymer dispersion from the working example 34 was dissolved in acetone, and the furosemide contained therein was quantified through high performance liquid chromatography under the following condition, to thereby confirm that the quantity of the furosemide remained unchanged before and after the stirring for mixing.

Column: Ascentis C18, 3 μm from SUPELCO, Catalog #581320-U

Elusion solution: Methanol, 2 ml/min, 40° C.

Detection: UV (280 nm)

Comparative Example 10

The same material as that of the working example 31 was introduced into a polyethylene bag in the same weight ratio, and manually shaken for mixing for 5 minutes at room temperature, to thereby obtain a physical mixture of a drug and a polymer.

[Evaluation Test of Drug Dispersibility of Drug-Polymer Composite]

With respect to the drug-polymer dispersions from the working examples 31 to 34 and the physical mixture from the comparative example 10, X-ray diffraction was measured by an X-Ray diffraction apparatus Geigerflex Rad IB from Rigaku Corporation. The result is shown in FIG. 16.

Figure 16:
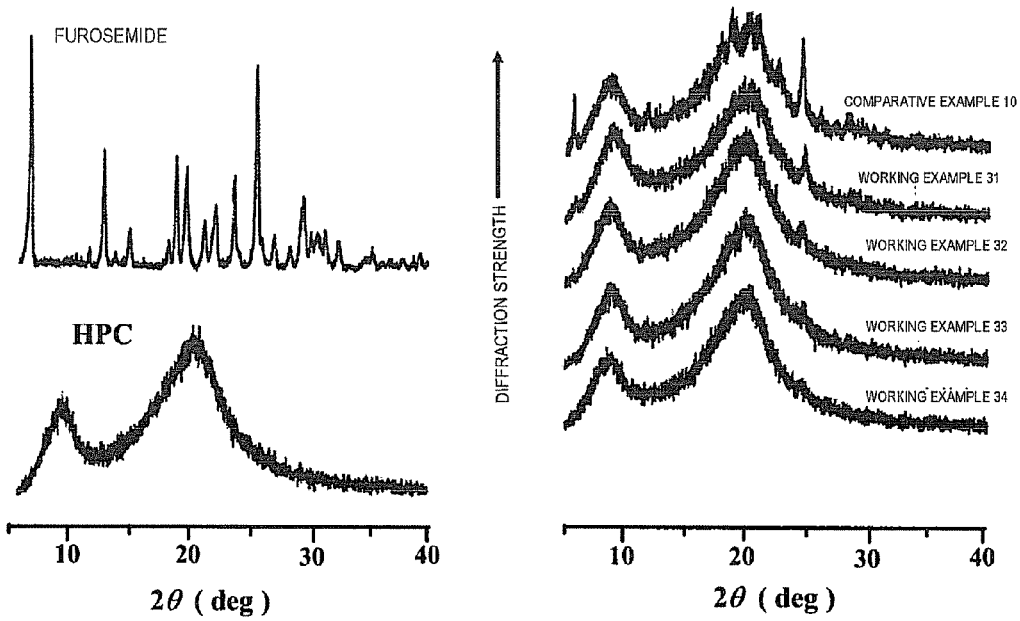
FIG. 16 includes characteristic charts showing powder X-ray crystal diffraction of working examples 31 to 34 and a comparative example 10.

The upper left portion of FIG. 16 represents the X-ray diffraction of the furosemide, and the lower left portion that of the HPC. On the right hand side of FIG. 16, the X-ray diffraction measurement results from the comparative example 10 and the working examples 31 to 34 are shown. In the physical mixture (comparative example 10) in the upper right portion, diffraction originating from the crystal of the furosemide is observed, however through the process of 1 minute (working example 31) the diffraction originating from the crystal becomes smaller, and the diffraction becomes still smaller with the longer processing time, until completely disappearing after the process of 30 minutes (working example 34).

Figure 17:
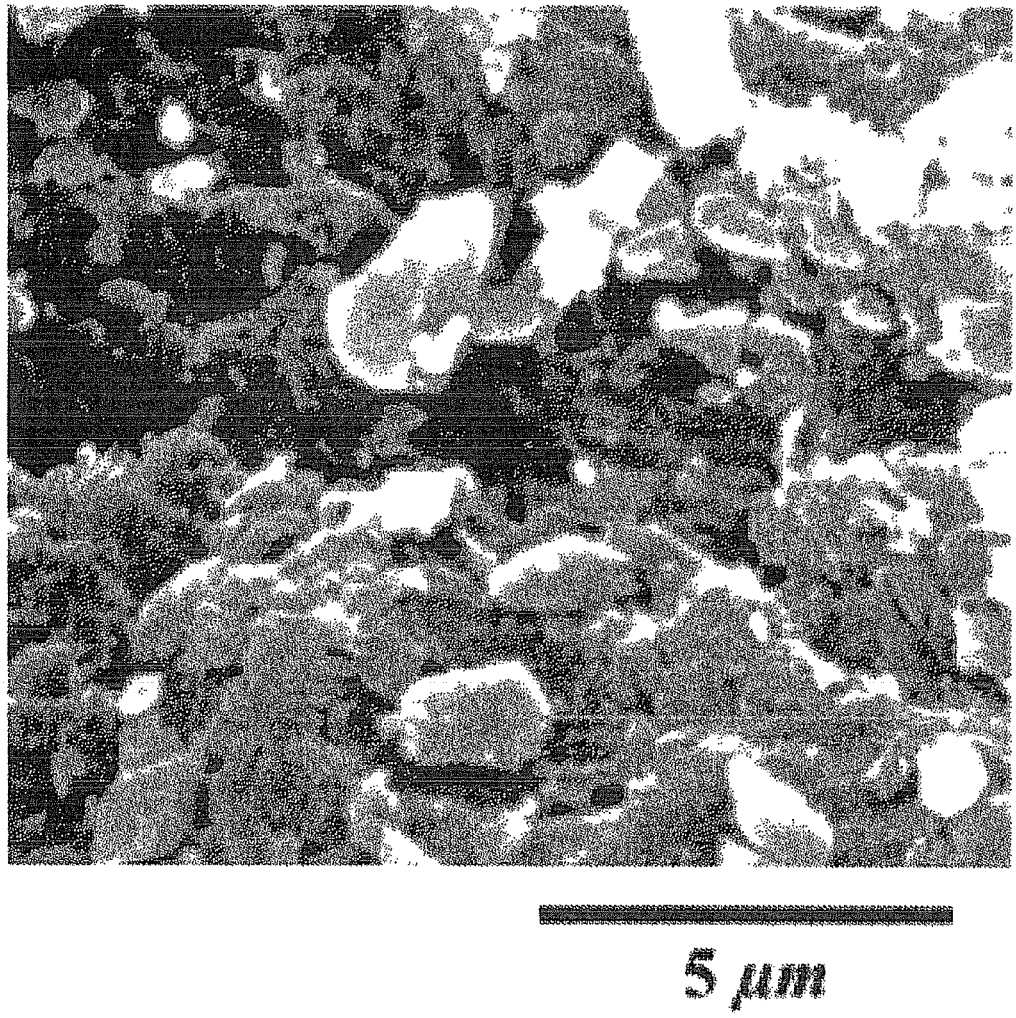
FIG. 17 is a schematic expression showing an observation result of the comparative example 10 through an electromicroscope.
Figure 18:
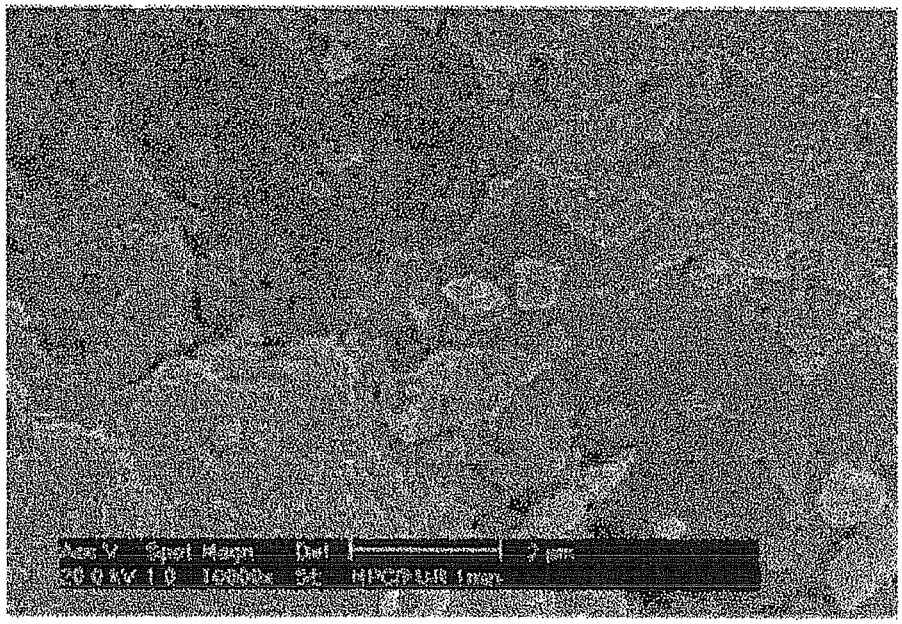
FIG. 18 is a schematic expression showing an observation result of the working example 31 through the electromicroscope.
Figure 19:
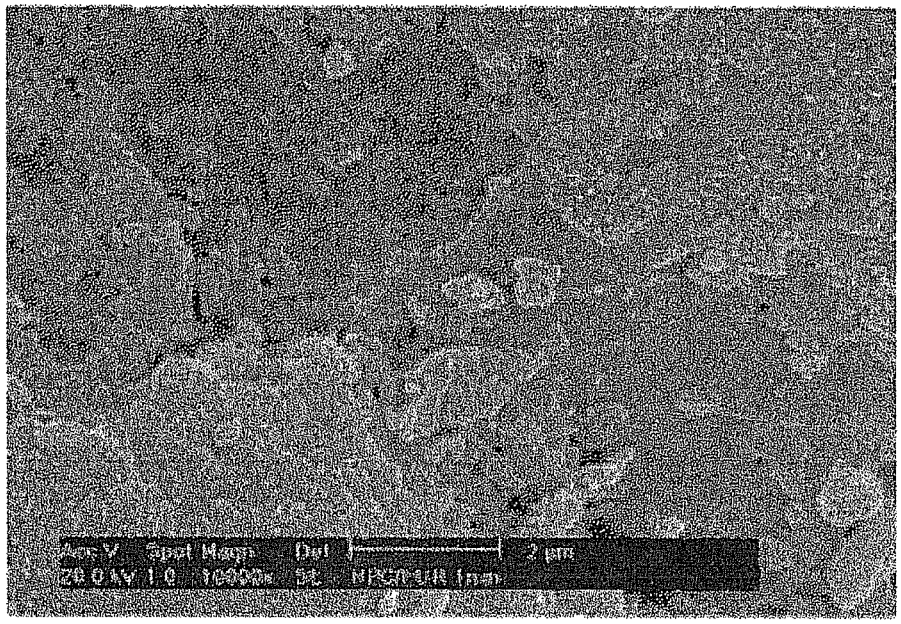
FIG. 19 is a schematic expression showing an observation result of the working example 32 through the electromicroscope.
Figure 20:
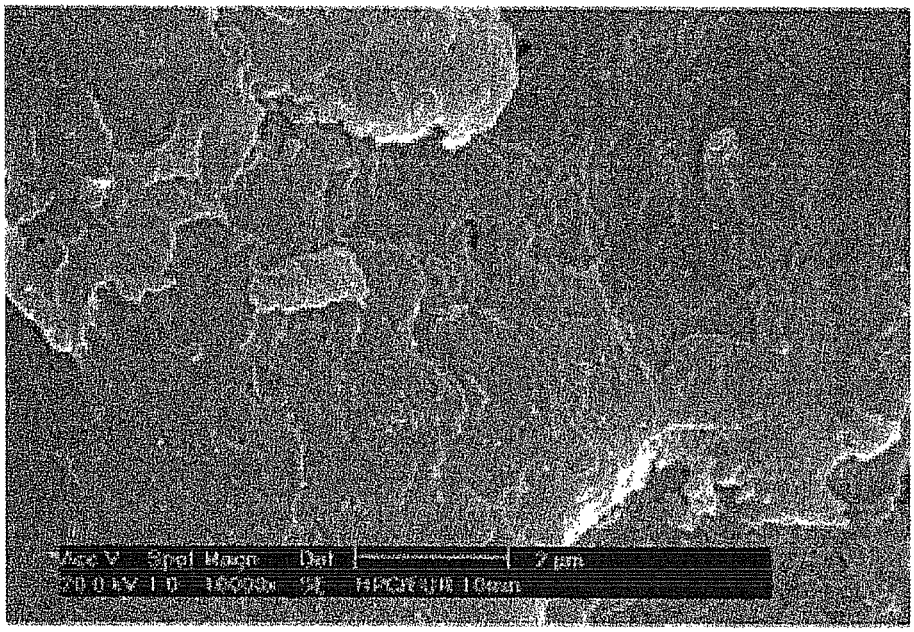
FIG. 20 is a schematic expression showing an observation result of the working example 33 through the electromicroscope.
Figure 21:
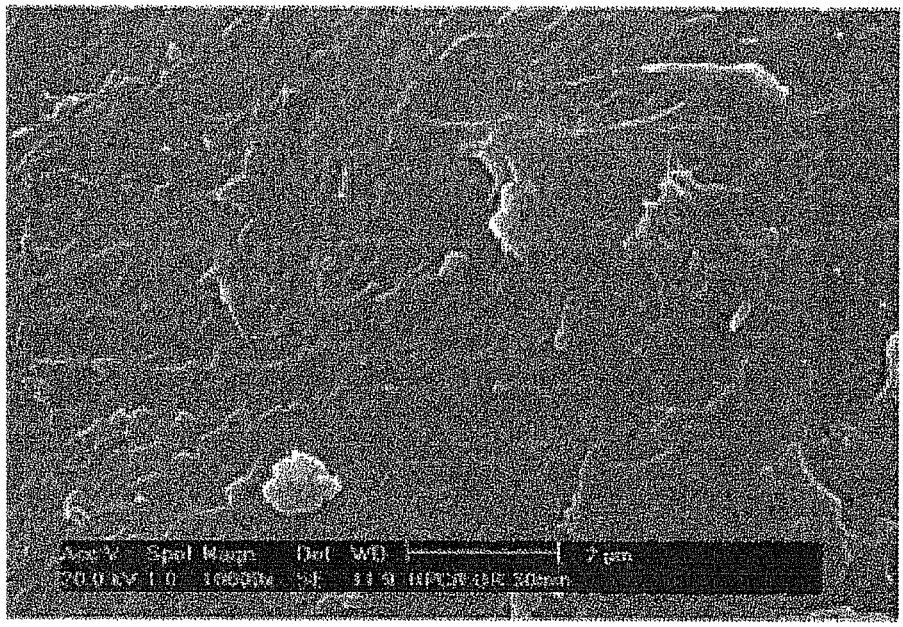
FIG. 21 is a schematic expression showing an observation result of the working example 34 through the electromicroscope.

FIG. 17 is a schematic expression showing an observation result through an electromicroscope, of the surface of the physical mixture from the comparative example 10, in which the furosemide of several microns stuck to the surface of the HPC particle can be observed.

FIGS. 18 to 21 are schematic expression showing an observation result through an electromicroscope, of the particle surface of the drug-polymer composite from the working examples 31 to 34 respectively, in view of which it is understood that the small particles on the HPC surface, which seemingly represent the furosemide, become smaller as the processing time is extended, and after the process of 30 minutes (working example 34) the HPC surface becomes smooth with no particles remaining thereon.

This indicates that at least a part of the furosemide, the drug, remains on the HPC surface after a short processing time, however as the processing time is extended the furosemide intrudes from the particle surface of the HPC and is dispersed inside.

Figure 22:
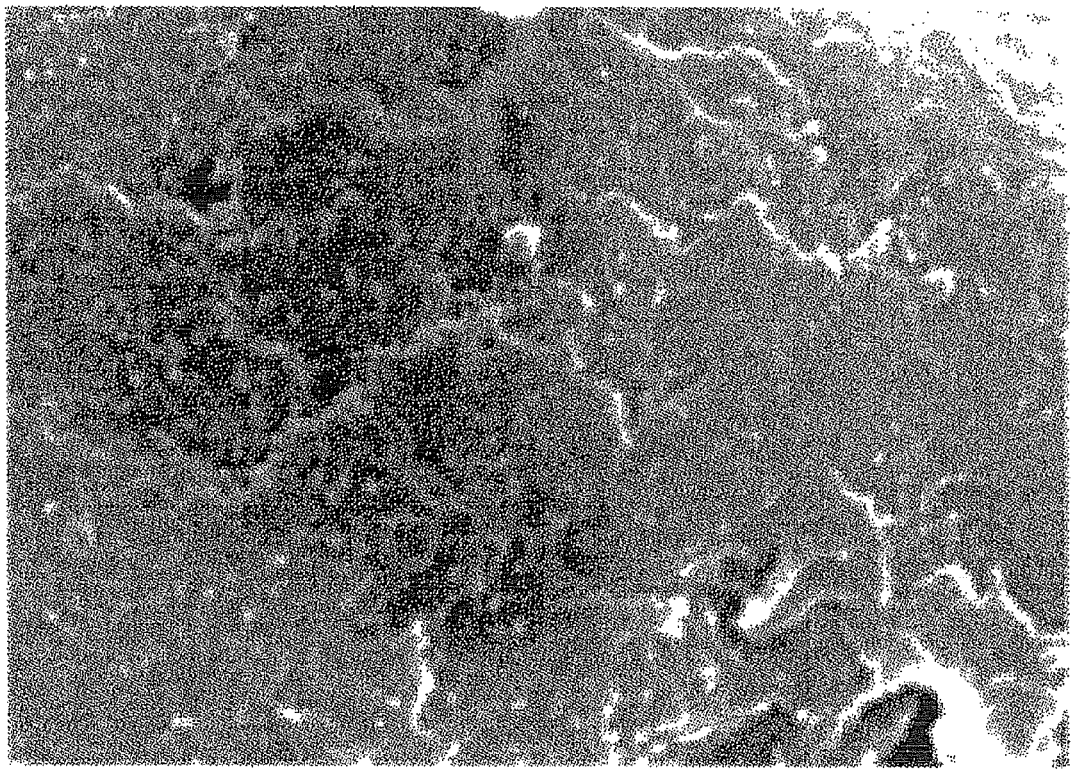
FIG. 22 is a schematic expression showing an observation result of the working example 32 through the electromicroscope.
Figure 23:
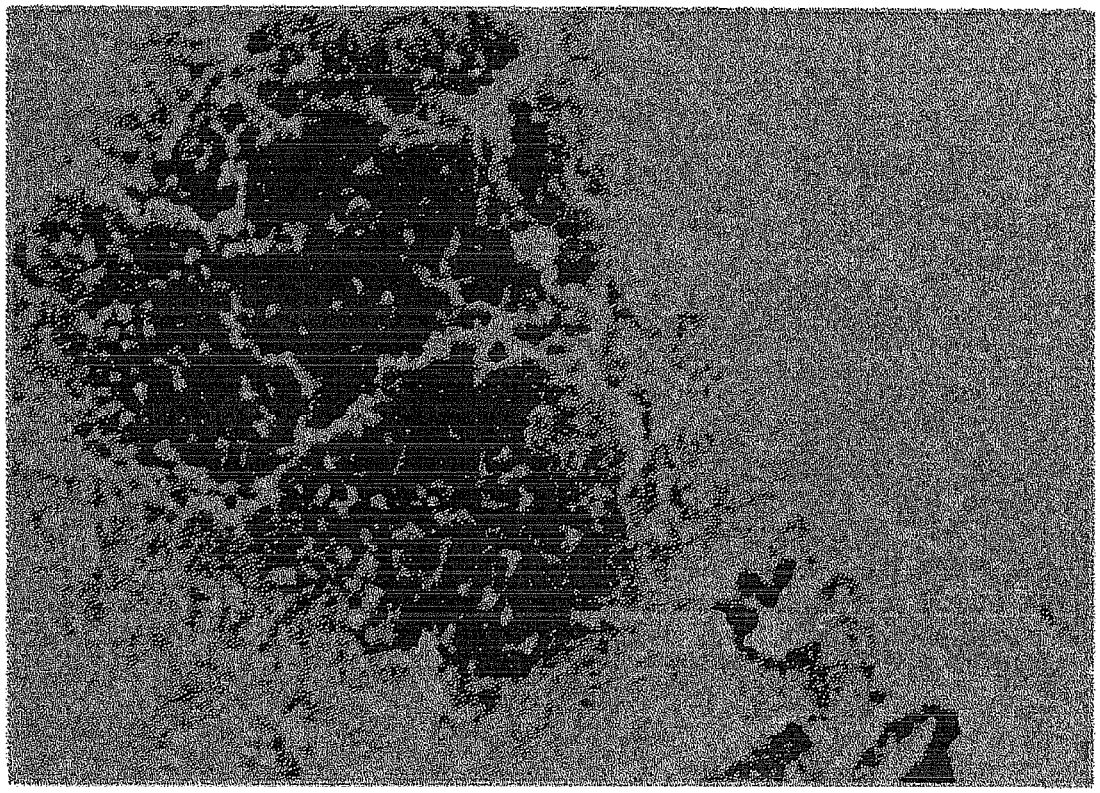
FIG. 23 is a schematic expression showing an observation result of the working example 32 through an energy-dispersive X-ray fluorescence spectrometer.

FIG. 22 is a schematic expression showing an observation result of the particle surface of the drug-polymer dispersion from the working example 32 through the electromicroscope, and FIG. 23 shows a result of energy-dispersive X-ray fluorescence spectrometry of the same portion. In view of these drawings, small white dots are distributed all over FIG. 23, which originate from the phosphor atom contained in the furosemide, and therefore it is understood that the phosphor atom i.e. the furosemide is dispersed quite uniformly and finely over the surface of the HPC particles.

Based on the results of the X-ray diffraction with respect to the working examples 31 to 34 in combination with the results shown in Table 4, it is understood that in the dispersion according to the present invention the drug intrudes into inside the polymer particle, which is the carrier, and is uniformly dispersed therein.

[Evaluation of Solubility]

Figure 24:
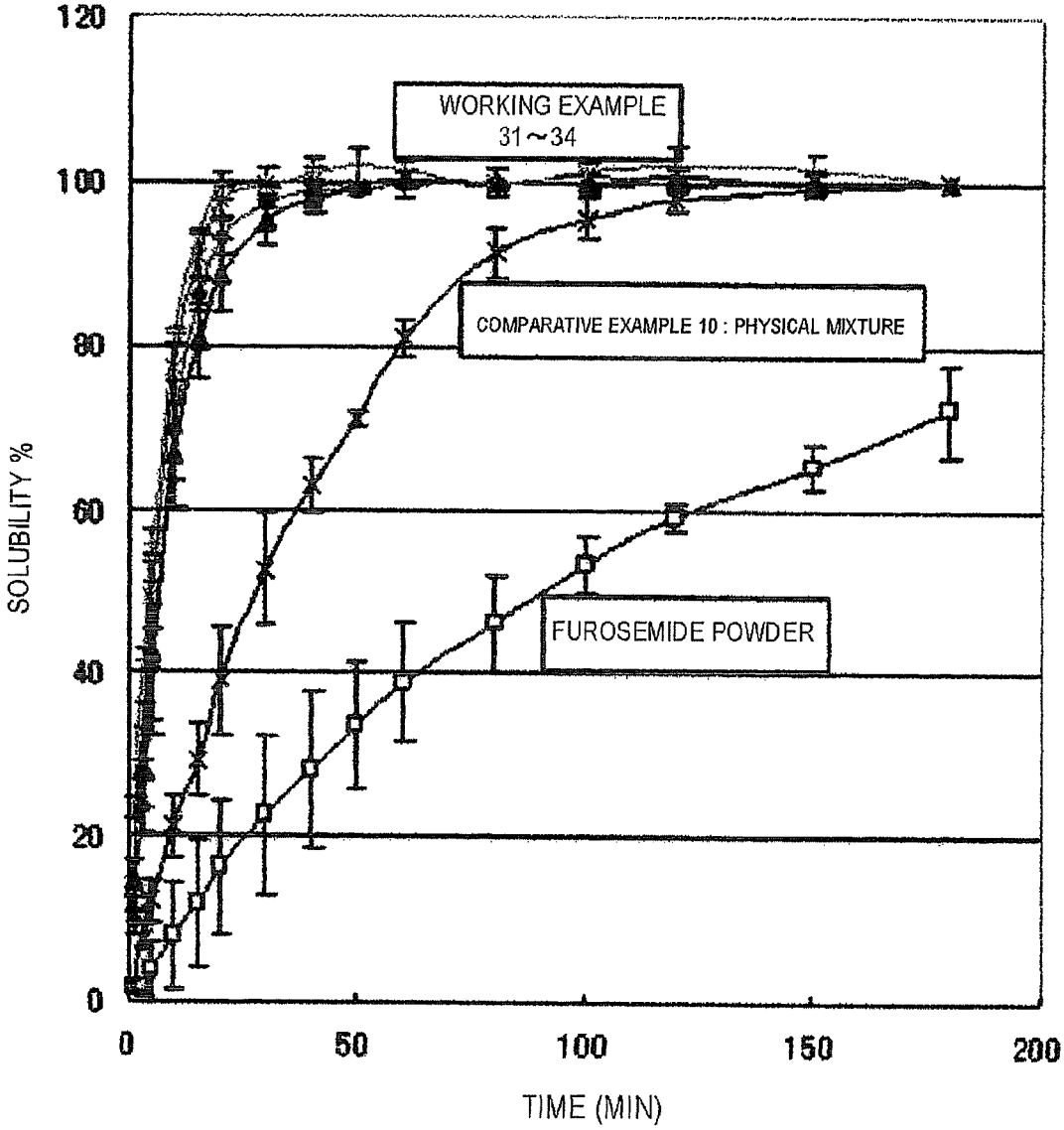
FIG. 24 is a characteristic chart showing dissolution rates of a chemical substance with respect to the working examples 31 to 34 and the comparative example 10.
Figure 25:
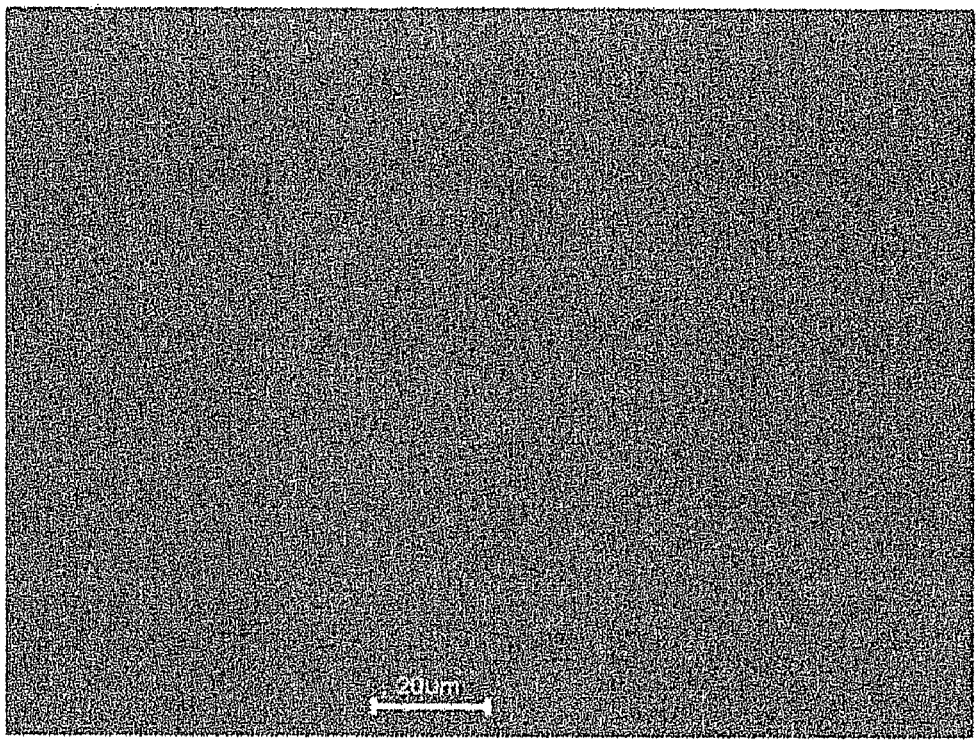
FIG. 25 is a schematic expression showing an observation result of the working example 35 through an optical microscope.
Figure 26:
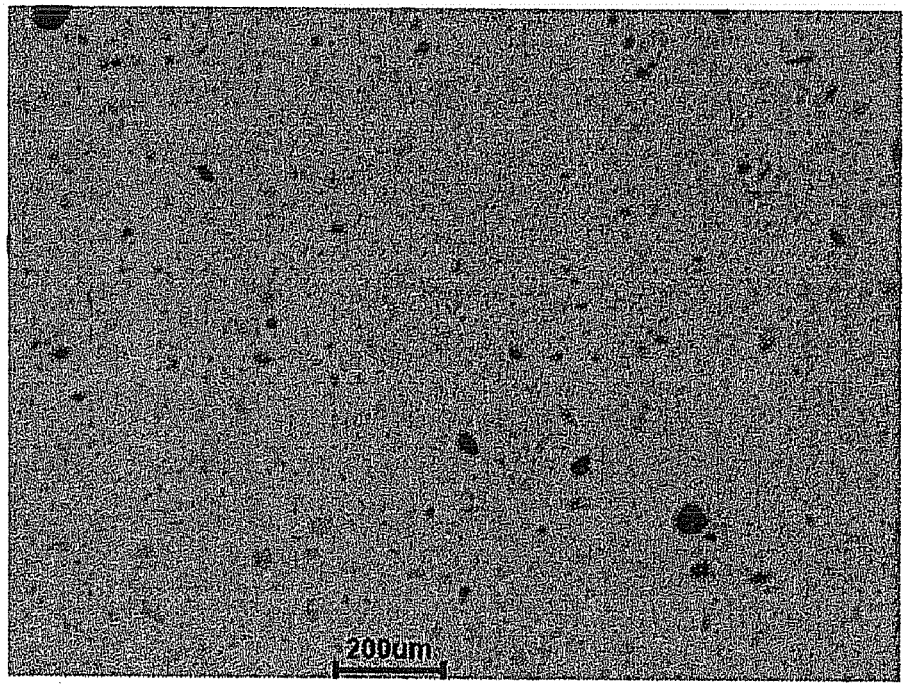
FIG. 26 is a schematic expression showing an observation result of the comparative example 11 through the optical microscope.
Figure 27:
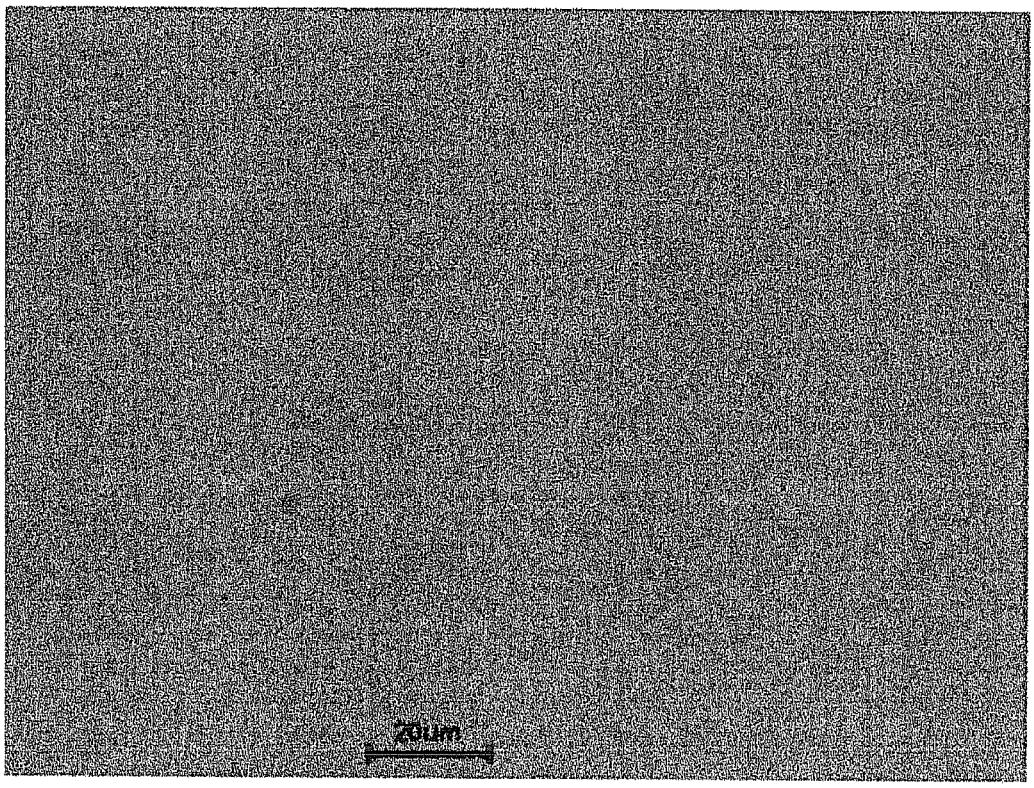
FIG. 27 is a schematic expression showing an observation result of the working example 36 through the optical microscope.
Figure 28:
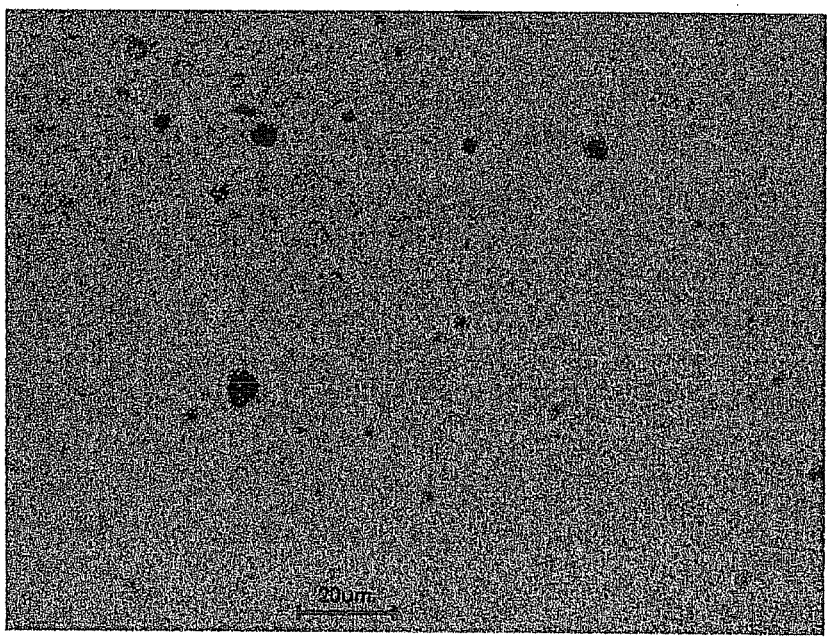
FIG. 28 is a schematic expression showing an observation result of the comparative example 12 through the optical microscope.
Figure 29:
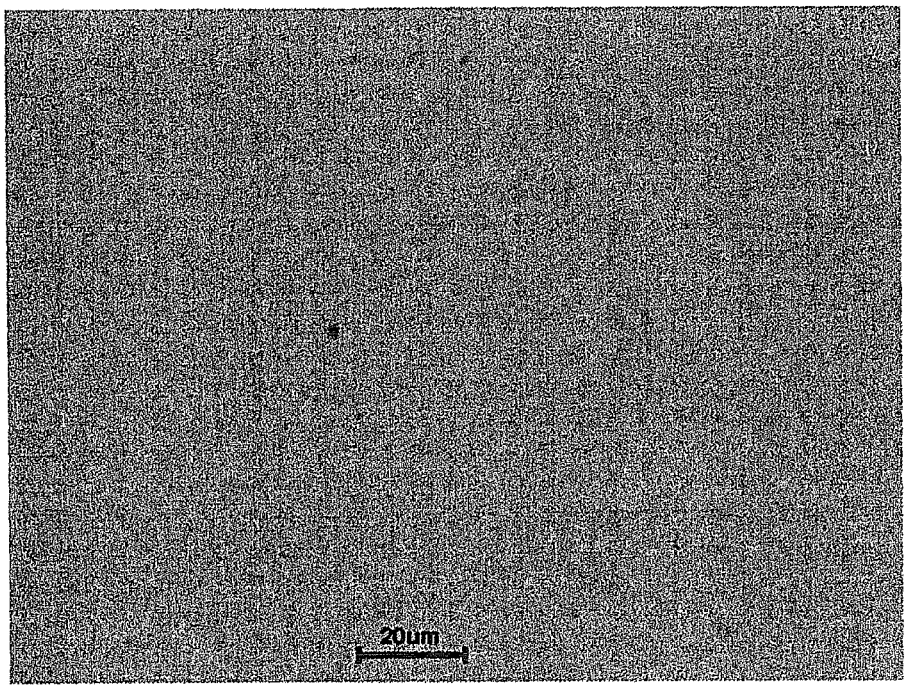
FIG. 29 is a schematic expression showing an observation result of the working example 37 through the optical microscope.
Figure 30:
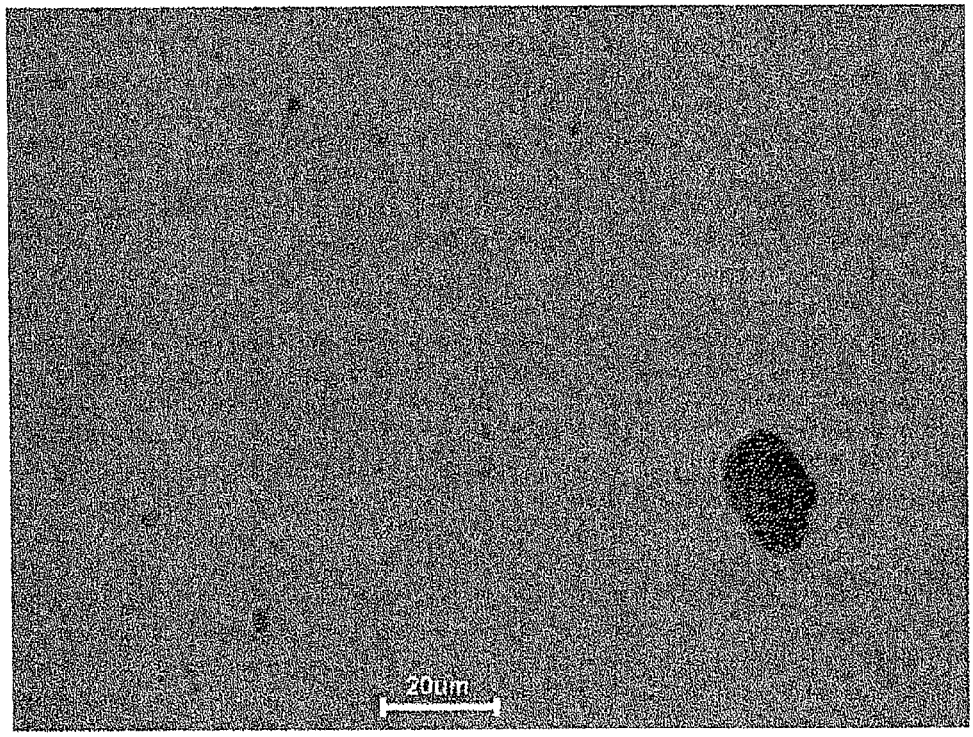
FIG. 30 is a schematic expression showing an observation result of the comparative example 13 through the optical microscope.

With respect to the drug-polymer dispersion from the working example 31 to 34, the physical mixture from the comparative example 10 and the furosemide powder, elusion test was executed according to the elusion test method specified in the 14$^{th}$ Edition of Japan Pharmacopoeia. The result is shown in FIG. 24, in view of which it is understood that the dissolution speed of the dispersion from the working examples 31 to 34 is evidently faster than the furosemide powder and the physical mixture.

3. Polyethylene-Pigment Dispersion

Working Example 35

79 weight part of low-density polyethylene (Petrothene 202R from Tosoh Corporation, mechanically crushed, particle diameter 200 μm to 500 μm), 20 weight part of fine particle iron oxide (Sicotrans Red L2715D from BASF Japan Ltd., particle diameter 20 nm), 1 weight part of zinc stearate (SZ-2000 from Sakai Chemical Industry Co., Ltd.), and 20 weight part of distilled water were stirred in the same dispersing apparatus as that of the working example 1, at a circumferential speed of 42 m/sec until the mixture was molten, to thereby obtain a polyethylene-iron oxide dispersion.

Comparative Example 11

The composition obtained upon removing the distilled water from the working example 35 was stirred in a Henschel mixer at a circumferential speed 42 m/sec at the distal edge of the vane for 5 minutes, and then molten and kneaded in the Brabender mixer (Labo Plastomill from Toyo Seiki Seisakusho, Ltd.) for 5 minutes, at a rotation speed of 80 rpm, to thereby obtain a polyethylene-iron oxide dispersion.

[Evaluation Test of Pigment Dispersibility]

The dispersion thus obtained was diluted with the employed resin until the pigment content became 3 wt %, and formed into an inflation film of 30 μm in thickness, and the number of aggregations larger than 0.1 mm$^2$ present in a volume of 1 cm$^3$ was measured, the result of which is shown in Table 5. Separately, the film was observed through an optical microscope of 400 times magnification, and the schematic expression of the observation result is shown in FIGS. 25 to 30.

TABLE 5

| | WORKING EXAMPLE 35 | COMPARATIVE EXAMPLE 11 | WORKING EXAMPLE 36 | COMPARATIVE EXAMPLE 12 | WORKING EXAMPLE 37 | COMPARATIVE EXAMPLE 13 |
|---|---|---|---|---|---|---|
| NUMBER OF AGGREGATIONS/cm$^3$ | 0 | 30 | 0 | 38 | 0 | 43 |

Working Example 36

70 weight part of low-density polyethylene (Petrothene (registered trademark) 354 from Tosoh Corporation, mechanically crushed, particle diameter 200 μm to 500 μm), 30 weight part of quinacridone (Fastogen Super Magenta RE-03 from Dainippon Ink & Chemicals, Inc.), 40 weight part of distilled water, and 0.6 weight part of dispersing agent (polyethylene glycol monostearate (40E.O.) from Wako Pure Chemical Industries, Ltd.) were processed in the same dispersing apparatus as that of the working example 1 at a circumferential speed 37 m/sec for 3 minutes, and successively processed at a circumferential speed of 42 m/sec until the mixture was molten, to thereby obtain a polyethylene-quinacridone dispersion.

Comparative Example 12

The composition obtained upon removing the distilled water from the working example 36 was stirred in a Henschel mixer at a circumferential speed 42 m/sec at the distal edge of the vane for 5 minutes, and then processed by 2 rolls at 120° C. for 5 minutes, to thereby obtain a polyethylene-quinacridone dispersion.

Working Example 37

55 weight part of low-density polyethylene (Petrothene 354 from Tosoh Corporation, mechanically crushed, particle diameter 200 μm to 500 μm), 45 weight part of azoic pigment (Seikafast Red 1980 from Dainichiseika Color & Chemicals Mfg. Co., Ltd.), 40 weight part of distilled water, and 0.9 weight part of dispersing agent (polyoxyethylene(23)laurylether from Wako Pure Chemical Industries, Ltd.) were processed in the same dispersing apparatus as that of the working example 1 at a circumferential speed 37 m/sec for 5 minutes, and successively processed at a circumferential speed of 42 m/sec until the mixture was molten, to thereby obtain a polyethylene-azoic pigment dispersion.

Comparative Example 13

The composition obtained upon removing the distilled water from the working example 37 was stirred in a Henschel mixer at a circumferential speed 42 m/sec at the distal edge of the vane for 5 minutes, and then processed by 2 rolls at 120° C. for 5 minutes, to thereby obtain a polyethylene-azoic pigment dispersion.

[Evaluation of Pigment Dispersibility]

As shown in Table 5, through comparison between the working example 35 and the comparative example 11, between the working example 36 and the comparative example 12, and between the working example 37 and the comparative example 13, it is understood that in all the cases the number of aggregations in the film of the working examples according to the present invention is zero, which indicates excellent dispersibility. Also, from the schematic expressions of the observation results through the optical microscope shown in FIGS. 25 to 30, superior dispersibility of the working examples according to the present invention can be explicitly appreciated.

Working Example 38

80 weight part of low-density polyethylene (F522N from Ube-Maruzen Polyethylene Co., Ltd., mechanically crushed, particle diameter 200 μm to 500 μm), and 20 weight part of fine particle zinc oxide (Nanofine 50LP from Sakai Chemical Industry Co., Ltd., particle diameter 20 nm) were processed in the same dispersing apparatus as that of the working example 1 at a circumferential speed 37 m/sec for 3 minutes, and 20 weight part of distilled water was added, after which the mixture was successively processed at a circumferential speed of 42 m/sec until being molten, to thereby obtain a polyethylene-fine particle zinc oxide dispersion.

Comparative Example 14

The composition obtained upon removing the distilled water from the working example 38 was stirred in a Henschel mixer at a circumferential speed 42 m/sec at the distal edge of the vane for 5 minutes, and then the whole material was introduced into the Brabender mixer (Labo Plastomill from Toyo Seiki Seisakusho, Ltd.) and molten and kneaded at 120° C. for 5 minutes at a rotation speed of 80 rpm, to thereby obtain a polyethylene-fine particle zinc oxide dispersion.

[Evaluation Test of Transparency]

Figure 31:
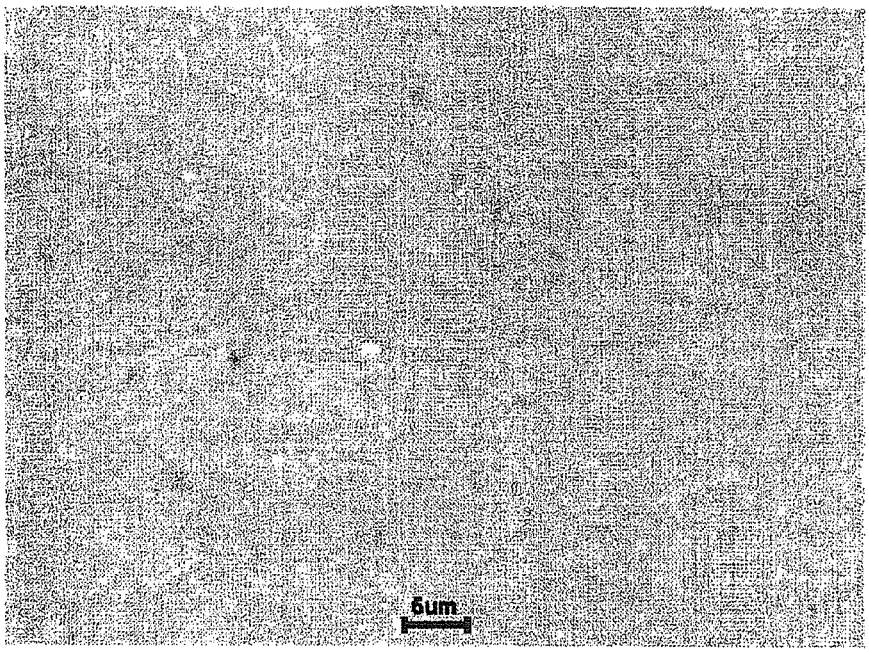
FIG. 31 is a schematic expression showing an observation result of the working example 38 through the optical microscope.
Figure 32:
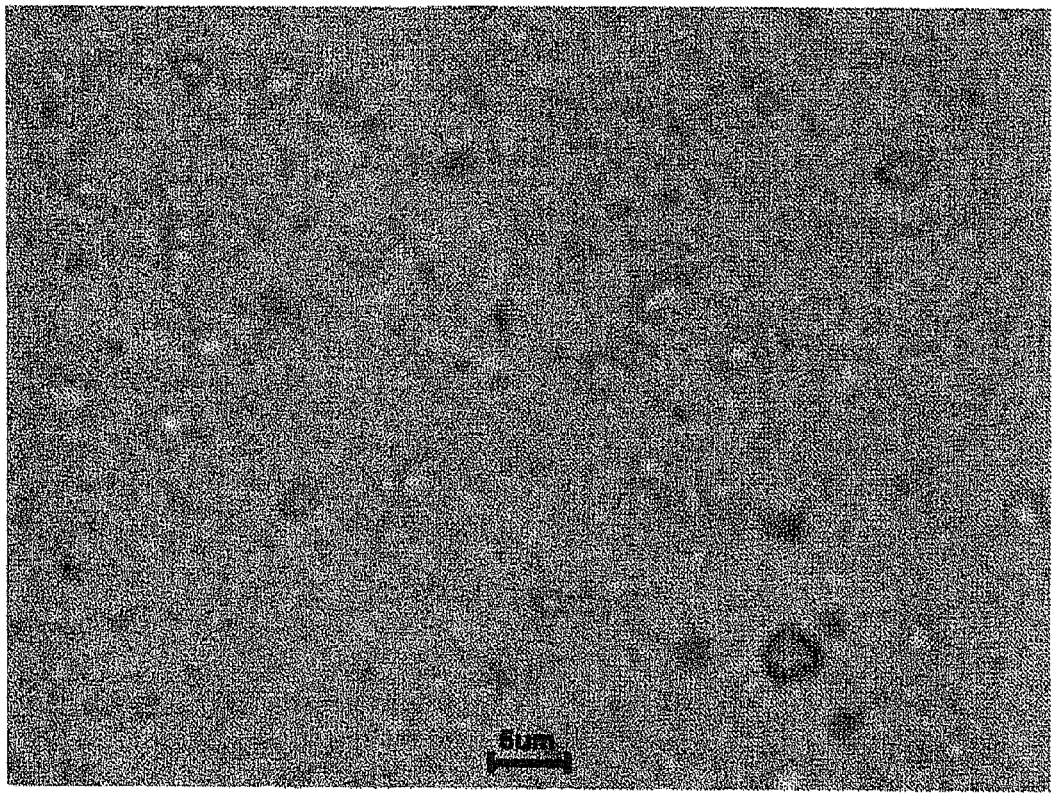
FIG. 32 is a schematic expression showing an observation result of the comparative example 14 through the optical microscope.

The dispersion from the working example 38 and the comparative example 14, and the original low-density polyethylene itself before the processing were formed into a sheet of 0.5 mm in thickness, and the haze value was measured by the direct-reading haze meter from Toyo Seiki Seisakusho, Ltd. according to JIS-K-7136-1, the result of which is shown in Table 6, in view of which it is understood that the working example 38 is superior in dispersibility and is hence has higher transparency, because of the lower haze value than the comparative example 14. Also, from the schematic expressions of the observation results through the optical microscope shown in FIG. 31 (working example 38) and FIG. 32 (comparative example 14), superior dispersibility of the working example can be explicitly appreciated.

TABLE 6

| | WORKING EXAMPLE 38 | COMPARATIVE EXAMPLE 14 | BEFORE PROCESSING |
|---|---|---|---|
| HAZE VALUE | 47 | 69 | 35 |

Industrial Applicability

The present invention provides a dispersion method and dispersing apparatus that enable efficiently giving a fine and highly uniform dispersion of a liquid and another liquid, a liquid and a solid, or a solid and another solid while suppressing characteristic degradation, and a method of manufacturing a dispersion that employs such dispersing apparatus.

To cite a few examples, an oil-type substance such as an aromatic may be finely dispersed in water for manufacturing a cosmetic article; powder such as a pigment may be finely and uniformly dispersed in water to thereby manufacture an ink-jet printing ink; a drug may be finely and uniformly dispersed in a medical drug carrier so as to improve the absorption of a poorly soluble drug; and a pigment may be finely and uniformly dispersed in a resin, thus to manufacture a colored resin.

It should be noted that although different working examples 1 to 38 have been described, the working examples 1 to 27, and 31 to 38 are related to a melt mixing process of melting only the surface of a solid material to be dispersed for mixing and kneading.

The invention claimed is:

1. A dispersing apparatus, comprising a container having a cylindrically shaped cavity; a stirring member pivotally supported rotatably and coaxially with said cavity, and disposed inside said cavity; and a rotational driving unit that rotationally drives said stirring member in a predetermined direction, to thereby stir a material to be dispersed introduced into said cavity of said container, with said stirring member rotationally driven by said rotational driving unit;

wherein said stirring member includes a column-shaped rotating shaft rotatably supported so as to be rotationally driven by said rotational driving unit, and a plurality of vanes provided at an even number of positions on an outer circumferential surface of said rotating shaft at regular intervals along a rotation direction;

an odd-numbered one of said vanes counted along said rotation direction has an attack angle of a negative value and is located at a relatively lower position and an even-numbered one of said vanes has an attack angle of a positive value and is located at a relatively upper position, with an axial direction of said rotating shaft being taken as up-and-down direction; and $-A/2 \leqq B \leqq A/2$ is satisfied, where A represents a vertical width of said vane and B represents a distance between an upper edge of said odd-numbered vane and a lower edge of said even-numbered vane.

2. The dispersing apparatus according to claim 1, wherein said distance B further satisfies $0 \leqq B$.

3. The dispersing apparatus according to claim 1, wherein a front edge of an odd-numbered one of said vanes is located close to a bottom surface of said cavity, and a front edge of an even-numbered one of said vanes is located close to a ceiling surface of said cavity.

4. The dispersing apparatus according to claim 1, wherein a plurality of sets of said odd-numbered vane and said even-numbered vane is axially aligned along said rotating shaft.

5. The dispersing apparatus according to claim 4, wherein a front edge of a lowermost one of said vanes at an odd-numbered position is located close to a bottom surface of said cavity, and a front edge of an uppermost one of said vanes at an even-numbered position is located close to a ceiling surface of said cavity.

6. The dispersing apparatus according to claim 1, wherein an attack angle of said vane is smaller than a stall angle.

7. The dispersing apparatus according to claim 1, wherein a plane orthogonal to said axial direction is formed along an extension of said front edge of said vane.

8. The dispersing apparatus according to claim 1, wherein a distal edge of said vane is of an arcuate shape generally parallel to an inner circumferential surface of said cavity.

9. The dispersing apparatus according to claim 1, wherein a front edge and a rear edge of said vane are generally parallel.

10. The dispersing apparatus according to claim 9, wherein a front-to-back width of said vane is smaller than a diameter of said rotating shaft.

11. The dispersing apparatus according to claim 1, further comprising a temperature control flow path provided inside of at least one of a container member and said stirring member; and a temperature control mechanism that causes a heat-transfer fluid to flow through said temperature control flow path.

12. The dispersing apparatus according to claim 1, wherein said vane is shaped and disposed so as to cause, by rotating in a predetermined direction, said material to be dispersed to rotate generally parallel to an inner circumferential surface of said cavity and to reciprocate axially of said rotating shaft.

13. The dispersing apparatus according to claim 1, wherein said material to be dispersed is localized in the vicinity of said inner circumferential surface of said cavity, and caused to flow under such state.

14. The dispersing apparatus according to claim 1, wherein a plurality of solid materials is molten and kneaded as said material to be dispersed.

15. The dispersing apparatus according to claim 1, wherein said material to be dispersed includes a first solid particle and a second solid particle; and said second solid particle is mixed in said first solid particle.

16. The dispersing apparatus according to claim 15, wherein said first solid particle is a resin particle, and said second solid particle is a pigment.

17. A dispersion method, comprising employing said dispersing apparatus according to claim 1 to stir a material to be dispersed in a cavity of a container, so as to create a laminar flow of said material to be dispersed.

18. The dispersion method according to claim 17, comprising causing said material to be dispersed introduced in said cylindrically shaped container to rotate generally parallel to an inner circumferential surface of said cavity, and to reciprocate in an axial direction.

19. The dispersion method according to claim 17, comprising localizing said material to be dispersed in the vicinity of an inner circumferential surface of said cavity, and causing said material to be dispersed under such state.

20. A method of manufacturing a dispersion, comprising employing said dispersing apparatus according to claim 1 to disperse a material to be dispersed including a dispersion medium and an additive to be dispersed therein.

21. The method according to claim 20, comprising employing a polymer as said dispersion medium.

22. The method according to claim 21, comprising employing a thermoplastic resin as said polymer.

23. The method according to claim 22, comprising employing polyolefin as said thermoplastic resin.

24. The method according to claim 20, comprising employing an inorganic substance, at least a polymer compound among organic substances and/or low molecular weight compound, as said additive.

25. The method according to claim 24, comprising employing a pigment as said additive.

26. The method according to claim 24, comprising employing a drug as said additive.

27. A dispersing apparatus, comprising a container including a bottom member, a cylindrically shaped wall member, and a lid member; and a column-shaped rotating shaft that rotates inside said cavity of said container, said rotating shaft being attached to said bottom member or said lid member such that an axial center of said rotating shaft becomes parallel to said cylindrically shaped wall member;

a pair of vanes attached to said rotating shaft with a predetermined inclination with respect to a rotation direction, and circumferentially spaced by 180 degrees and axially shifted from each other;

wherein said vane on said bottom member side is inclined such that a rear portion with respect to a rotation direction is elevated from said rotation plane toward said lid member;

said vane on said lid member side is inclined by the same angle as said vane on said bottom member side, such that a rear portion with respect to said rotation direction is lowered from said rotation plane away from said lid member;

a vane closest to said bottom member and a vane closest to said lid member out of said pair of vanes thus attached are located close to said bottom member and to said lid member respectively, but not in contact therewith;

$-A/2 \leqq B \leqq A/2$ is satisfied, where A represents a vertical width of said pair of vanes and B represents a distance between an upper edge of the vane on said bottom member side and a lower edge of the vane on said lid member side; and a laminar flow is created when a material to be dispersed is stirred in said cavity of said container.

28. A dispersing apparatus, comprising a structure in which a basic structure including said rotating shaft with said pair of vanes according to claim 27 is repeated axially of said rotating shaft and/or in a direction of a rotation plane;

wherein a vane closest to said bottom member and a vane closest to said lid member out of said even number of vanes provided are located close to said bottom member and to said lid member respectively, but not in contact therewith.

29. The dispersing apparatus according to claim 27, further comprising a structure that provided a refrigerant or a heating agent through said container member, said rotating shaft and/or inside of said vane.

* * * * *